US010906331B2

(12) United States Patent
Ohta et al.

(10) Patent No.: US 10,906,331 B2
(45) Date of Patent: Feb. 2, 2021

(54) RECORDING METHOD AND INK JET RECORDING APPARATUS

(71) Applicant: Seiko Epson Corporation, Tokyo (JP)

(72) Inventors: Hitoshi Ohta, Shiojiri (JP); Mitsuaki Kosaka, Minowa (JP)

(73) Assignee: Seiko Epson Corporation

( * ) Notice: Subject to any disclaimer, the term of this patent is extended or adjusted under 35 U.S.C. 154(b) by 25 days.

(21) Appl. No.: 16/361,311

(22) Filed: Mar. 22, 2019

(65) Prior Publication Data

US 2019/0291471 A1 Sep. 26, 2019

(30) Foreign Application Priority Data

Mar. 23, 2018 (JP) ..... 2018-056404

(51) Int. Cl.

| | |
|---|---|
| ***B41J 11/00*** | (2006.01) |
| ***B41M 5/00*** | (2006.01) |
| ***B41M 7/00*** | (2006.01) |

(52) U.S. Cl.

CPC ..... *B41J 11/002* (2013.01); *B41J 11/00* (2013.01); *B41M 5/00* (2013.01); *B41M 5/0017* (2013.01);

(Continued)

(58) Field of Classification Search

CPC ... B41J 2/01; B41J 2/211; B41J 2/1433; B41J 2/17; B41J 2/17593; B41J 2/2107;

(Continued)

(56) References Cited

U.S. PATENT DOCUMENTS

| | | | |
|---|---|---|---|
| 7,909,452 | B2 | 3/2011 | Yamashita et al. |
| 2009/0079807 | A1 | 3/2009 | Yamashita et al. |

(Continued)

FOREIGN PATENT DOCUMENTS

| | | | |
|---|---|---|---|
| CN | 101391517 | A | 3/2009 |
| EP | 2824150 | A1 | 1/2015 |

(Continued)

OTHER PUBLICATIONS

Extended European Search Report for EP Application No. 19164665.2, dated Oct. 25, 2019 (8 pages).

*Primary Examiner* — Manish S Shah
(74) *Attorney, Agent, or Firm* — Harness, Dickey & Pierce, P.L.C.

(57) ABSTRACT

An ink jet recording method includes attaching ink by ejecting an ink composition from a head to attach to a recording region of a recording medium, and drying by heating the recording medium to which the ink composition is attached, in which the ink composition is a water-based ink composition including a resin and an amide compound represented by General Formula (1) as an organic solvent, and the drying dries the organic solvent in the recording region of the recording medium to be 2.0 mg/inch$^2$ or less.

(1)

(Continued)

In Formula (1), $R^1$ represents a linear or branched alkyl group having 1 to 6 carbon atoms; $R^2$ and $R^{3s}$ represent each independently H or a linear or branched alkyl group having 1 to 4 carbon atoms.

20 Claims, 1 Drawing Sheet

(52) U.S. Cl.
CPC ..... *B41M 5/0023* (2013.01); *B41M 7/00* (2013.01); *B41M 7/009* (2013.01); *B41M 7/0018* (2013.01)

(58) Field of Classification Search
CPC ..... B41J 2/1755; B41J 2/2114; B41J 2/2117; B41J 2/2056; B41J 2/0057; B41J 3/60; B41J 2002/012; B41J 2/04598; B41J 2/1623; B41J 2202/00; B41J 2202/03; B41J 2/14201; B41J 2/045; B41J 11/0015; B41J 11/002; B41J 2/04581; B41J 2/055; B41J 2002/16502; B41J 29/02; B41J 2/17513; B41J 2/17509; B41J 29/13; B41J 2/17553; B41J 2/1606; B41J 2/1642; B41J 2/1609; B41J 2/164; B41J 2/162; B41J 2/161; B41J 2/19; B41J 15/04; B41J 25/001; B41J 25/34; B41J 25/003; B41J 2/21; B41J 25/312; B41J 2025/008; B41J 2202/21; B41J 2/17596; B41J 2/16508; B41J 2/1652; B41J 2/16538; B41J 2/175; B41J 2/04588; B41J 2/04595; B41J 2/04586; B41J 2/14274; B41J 2/17563; B41M 5/0011; B41M 5/0017; B41M 5/0023; B41M 5/0047; B41M 7/00; B41M 7/0072; B41M 5/52; B41M 5/5218; B41M 5/5227; C09D 11/36; C09D 11/40; C09D 11/30; C09D 11/38; C09D 11/32; C09D 11/322; C09D 11/324; C09D 11/328; C09D 11/101; C09D 11/102; C09D 11/005; C09D 11/54; C09D 11/52; C09D 11/106; C09D 11/326; C09D 11/107; C09D 11/03; C09D 11/037; C09D 11/033
See application file for complete search history.

(56) References Cited

U.S. PATENT DOCUMENTS

| | | | | |
|---|---|---|---|---|
| 2013/0194343 | A1* | 8/2013 | Yokohama | C09D 11/322 347/20 |
| 2013/0222503 | A1* | 8/2013 | Okuda | B41J 11/0015 347/102 |
| 2015/0015639 | A1* | 1/2015 | Ito | C09D 11/40 347/21 |
| 2016/0264808 | A1* | 9/2016 | Kido | C09D 11/322 |
| 2016/0303873 | A1* | 10/2016 | Okuda | B41J 11/0015 |

FOREIGN PATENT DOCUMENTS

| | | | |
|---|---|---|---|
| JP | 2017-019972 | A | 1/2017 |
| JP | 6-102260 | B2 | 3/2017 |

* cited by examiner

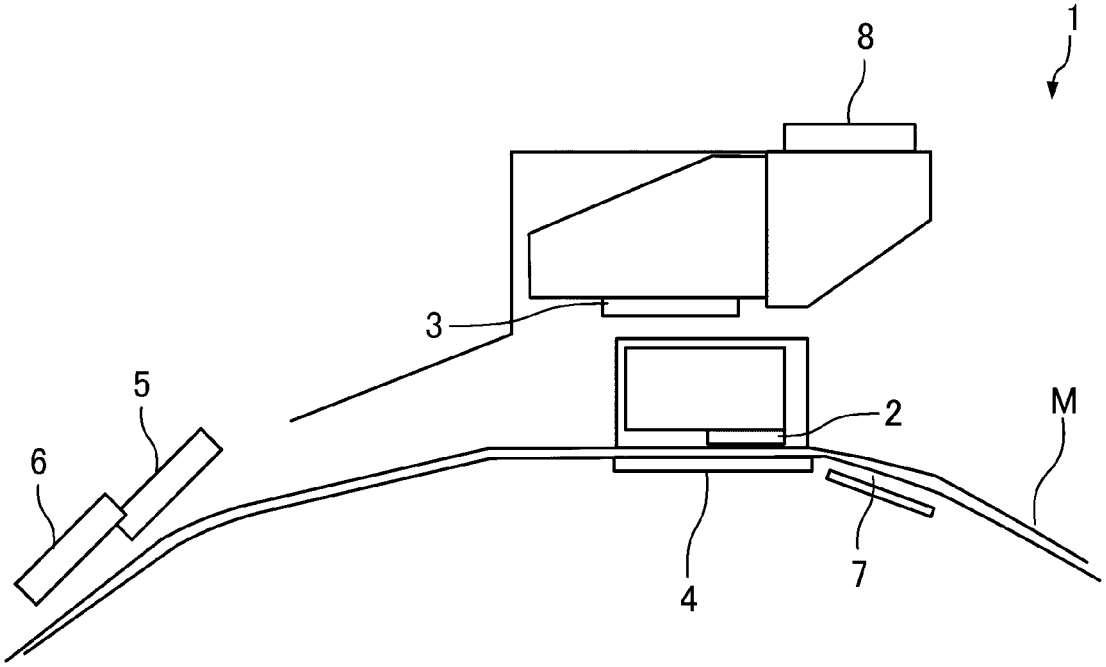
1
8
3
5
6
2
M
4
7

RECORDING METHOD AND INK JET RECORDING APPARATUS

BACKGROUND

1. Technical Field

The present invention relates to a recording method and an ink jet recording apparatus.

2. Related Art

In the ink jet recording method, small droplets of an ink composition are ejected from fine nozzles and are attached to a recording medium to perform recording. This method is able to record high resolution and high-quality images at a high speed with a relatively inexpensive apparatus.

In recent years, studies have been carried out on the direct recording (printing) of labels or the like for products on soft packaging films such as PET films using an ink jet recording method. In addition, soft packaging films have applications such as packaging foods and, in such applications, the recording surface of the soft packaging film is formed of a plastic material such as polyolefin, nylon, or polyester, and transparent or translucent materials are often used in order to be able to confirm the contents thereof.

In addition, in recent years, in the so-called sign graphics market such as advertising billboards, window graphics, and vehicle wrapping, applications for printing using the ink jet recording method have been expanding. In sign graphics, a wide range of materials are used as recording media, from banners, coated paper, matte paper, wallpaper, cloth, and plastic films such as PET and PVC. Among these, a form of advertisement signboard in which printing is directly carried out on a transparent/translucent plastic film and the film is pasted on a window or the like is rapidly becoming popular.

For example, JP-A-2017-019972 discloses an ink which is a water-based ink and includes water, an organic solvent, resin particles, and a coloring material, and a specific amide compound is used as an organic solvent. This document also discloses that, even in a case where the ink is used for recording onto a non-permeable base material, the image drying property is good, it is possible to obtain a high gloss image, and so on.

In general, the drying property of the ink is evaluated by a test of transferring the formed image to a filter paper (refer to JP-A-2017-019972) or a rubbing test with a cloth or the like. Therefore, even in a case where drying is sufficiently carried out in the test, it is not known how much the evaporating components of the ink, in particular, the organic solvent, evaporate and decrease.

There is a demand for an ink jet recording method and an ink jet recording apparatus for which the recorded matter is excellent in abrasion resistance and excellent in lamination resistance.

SUMMARY

Application Example 1

According to an aspect of the invention, there is provided an ink jet recording method including attaching ink to a recording region of a recording medium by ejecting an ink composition from a head, and heating the recording medium to which the ink composition is attached, in which the ink composition is a water-based ink composition including a resin and an amide compound represented by General Formula (1) as an organic solvent, and, in the heating, the organic solvent in the recording region of the recording medium is dried to be 2.0 mg/inch$^2$ or less.

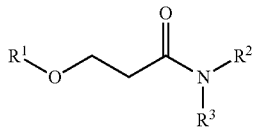

(1)

(In Formula (1), $R^1$ is a linear or branched alkyl group having 1 to 6 carbon atoms; $R^2$ and $R^3$ are each independently H or a linear or branched alkyl group having 1 to 4 carbon atoms.)

Application Example 2

In the ink jet recording method according to Application Example 1, in the heating, the organic solvent in the recording region of the recording medium may be dried to be 0.1 mg/inch$^2$ or more and 2.0 mg/inch$^2$ or less.

Application Example 3

The ink jet recording method according to Application Example 1 or Application Example 2 may further include attaching a treatment liquid, which includes an aggregating agent for aggregating components of the ink composition, to the recording region of the recording medium.

Application Example 4

In the ink jet recording method according to Application Example 3, the aggregating agent may be one or more types of a cationic resin, an organic acid, and a polyvalent metal salt.

Application Example 5

In the ink jet recording method according to Application Example 3 or Application Example 4, a recording region in which an attachment amount of the treatment liquid is 5.0% by mass or more and 20.0% by mass or less with respect to an attachment amount of the ink composition, may be provided.

Application Example 6

In the ink jet recording method according to any one of Application Example 1 to Application Example 5, a content of an organic solvent of a polyol having a standard boiling point of more than 280° C. in the ink composition may be 1.0% by mass or less with respect to a total mass of the ink composition.

Application Example 7

In the ink jet recording method according to any one of Application Example 1 to Application Example 6, the recording medium may be a low-absorption recording medium or a non-absorption recording medium.

Application Example 8

In the ink jet recording method according to any one of Application Example 1 to Application Example 7, the ink composition may include a urethane resin.

Application Example 9

In the ink jet recording method according to any one of Application Example 1 to Application Example 8, recorded matter obtained by the recording method may be used after being laminated.

Application Example 10

In the ink jet recording method according to any one of Application Example 1 to Application Example 9, the amide compound represented by General Formula (1) may be included as 5.0% by mass or more and 40.0% by mass or less with respect to a total mass of the ink composition.

Application Example 11

In the ink jet recording method according to any one of Application Example 1 to Application Example 10, the heating may be performed using one or more types of radiation, blowing, and heat transfer.

Application Example 12

In the ink jet recording method according to any one of Application Example 1 to Application Example 11, the ink composition may include, as an organic solvent, one or more types of polyols, alkanediols, and glycol ethers having a standard boiling point of 280° C. or lower.

Application Example 13

In the ink jet recording method according to any one of Application Example 1 to Application Example 12, a region in the recording region in which the attachment amount of the ink composition is 9.0 mg/inch$^2$ or more and 25.0 mg/inch$^2$ or less may be provided.

Application Example 14

In the ink jet recording method according to any one of Application Example 1 to Application Example 13, a colored ink composition including a resin and an organic solvent and a clear ink composition including a resin and an organic solvent may be used, and any one of the ink compositions may be a water-based ink composition.

Application Example 15

In the ink jet recording method according to Application Example 14, the content of the amide compound represented by General Formula (1) in the clear ink composition may be 1% by mass or less.

Application Example 16

According to another aspect of the invention, there is provided an ink jet recording apparatus for performing recording by the ink jet recording method according to any one of Application Example 1 to Application Example 15.

BRIEF DESCRIPTION OF THE DRAWING

The invention will be described with reference to the accompanying drawing, wherein like numbers reference like elements.

FIGURE is a schematic sectional view schematically showing an ink jet recording apparatus.

DESCRIPTION OF EXEMPLARY EMBODIMENTS

Several embodiments of the invention will be described below. The embodiments described below explain one example of the invention. The invention is not limited to the following embodiments at all, and includes various modifications carried out without departing from the gist of the invention. Note that not all of the configurations described below are necessarily indispensable components of the invention.

1. RECORDING METHOD

The ink jet recording method according to the present embodiment is provided with an ink attaching step of ejecting an ink composition from a head to attach to a recording region of a recording medium, and a drying step of heating the recording medium to which the ink composition is attached.

1.1. Recording Medium

The recording medium on which an image is formed by the ink jet recording method according to the present embodiment may have a recording surface which absorbs liquids such as ink and a treatment liquid or may not have a recording surface which absorbs liquid. Therefore, the recording medium is not particularly limited, and examples thereof include liquid absorbing recording media such as paper, film, and cloth, liquid low-absorption recording media such as printed paper, liquid non-absorption recording media such as metal, glass, and polymers, and the like. However, the excellent effect of the ink jet recording method of the present embodiment is more remarkable in the case of recording an image on a liquid low-absorption or liquid non-absorption recording medium.

The liquid low-absorption or liquid non-absorption recording medium refers to a recording medium having a property of not absorbing or absorbing almost none of the ink composition or the treatment liquid. Quantitatively, a liquid non-absorption or liquid low-absorption recording medium refers to a "recording medium having a water absorption amount of 10 mL/m$^2$ or less in 30 msec$^{1/2}$ from the start of contact in the Bristow method". This Bristow method is the most widely used method as a method for measuring the amount of liquid absorption in a short time and is also adopted by Japan Technical Association of the Pulp and Paper Industry (Japan TAPPI). The details of the test method are described in standard No. 51 "Paper and paperboard—Liquid absorbency test method—Bristow method" of "Japan TAPPI Paper Pulp Test Method 2000 Edition". On the other hand, the liquid absorbing recording medium refers to a recording medium which does not correspond to liquid non-absorption or liquid low-absorption. In this specification, liquid low-absorption or liquid non-absorption may be simply referred to as low absorption and non-absorption.

Examples of liquid non-absorption recording media include a recording medium in which a plastic is coated on a base material such as paper, a recording medium in which a plastic film is attached to a base material such as paper, a plastic film which does not have an absorbing layer (receiving layer), and the like. Examples of plastics here include polyvinyl chloride, polyethylene terephthalate, polycarbonate, polystyrene, polyurethane, polyethylene, polypropylene, and the like.

In addition, examples of a liquid low-absorption recording medium include a recording medium provided with a coating layer (receiving layer) for receiving a liquid such as ink or treatment liquid on the surface thereof, and examples of a recording medium in which the base material is paper include printed paper such as art paper, coated paper, and mat paper, and in a case where the base material is a plastic film, examples thereof include a recording medium in which a hydrophilic polymer or the like is coated on the surface of polyvinyl chloride, polyethylene terephthalate, polycarbonate, polystyrene, polyurethane, polyethylene, polypropylene, or the like, and a recording medium on which particles such as silica and titanium are coated with a binder.

It is possible to suitably use the ink jet recording method according to the present embodiment for a soft packaging film. The soft packaging film is one form of the liquid non-absorption recording medium described above. More specifically, soft packaging films are highly flexible film materials used for food packaging, toiletry, cosmetic packaging, and the like, materials having anti-fogging properties and anti-static properties, and film materials in which antioxidants and the like are present on the film surface and which have a thickness in the range of 5 to 70 μm (preferably 10 to 50 m). In a case where the ink composition or the like is attached to this film, it is harder to fix the composition, compared to a plastic film having a normal thickness, and even when fixed, the ink composition does not easily correspond to (follow) the flexibility of the film and peeling is likely to occur. However, the ink jet recording method according to the present embodiment is able to form a sufficiently good image on a soft packaging film.

In the materials forming the recording surface of the soft packaging film, it is possible to use materials including at least one type of resin selected from olefin-based resins (polyethylene, polypropylene, and the like), ester-based resins (polyester and the like), vinyl chloride-based resins (polyvinyl chloride and the like), amide-based resins (polyamide and the like). As the film base material including the recording surface of the soft packaging film, it is possible to use these resins processed into films or sheets. In the case of a film or sheet using a resin, it is possible to use any of an unstretched film, a stretched film stretched in a uniaxial direction or a biaxial direction, or the like, and using a film stretched in a biaxial direction is preferable. In addition, it is also possible to use films or sheets made of these various resins in a laminated state of being bonded to each other, as necessary.

In addition, it is also possible to suitably use the ink jet recording method according to the present embodiment for a recording medium for sign graphics. Recording media for sign graphics cover various media in which the base material is a banner, coated paper, matte paper, wallpaper, cloth, plastic films such as PET or PVC, or the like, as described above, but it is possible to particularly suitably use the ink jet recording method according to the present embodiment with respect to a transparent or translucent plastic film used for a window display, vehicle wrapping, or the like. These films are often used in a form in which the base material is formed of flexible polyolefin, PET, PVC, or the like and which has an adhesive layer on the opposite side to the printed surface, and, after printing, the films are used after being pasted on window glass, a car body, and the like using the adhesive surface. In a case where a treatment liquid is attached or the ink composition is attached to the film, the ink composition is not easily fixed, and even when fixed, the ink composition and the like do not easily correspond to (follow) the flexibility of the film and peeling is likely to occur. However, the ink jet recording method according to the present embodiment is also more suitable for films for sign graphics.

Regarding the materials forming the recording surface of a film for sign graphics, it is possible to use materials including at least one type of resin selected from olefin-based resins (polyethylene, polypropylene, and the like), ester-based resins (polyester and the like), vinyl chloride-based resins (polyvinyl chloride and the like), and amide-based resins (polyamide and the like).

The recording medium may be colorless transparent, translucent, colored transparent, colored opaque, colorless opaque, and the like. In addition, the recording medium itself may be colored, translucent, or transparent. In such a case, making an ink composition a white ink composition and using the ink composition as a background image ink composition makes it possible to have a function as a concealing layer for concealing the color of the recording medium itself. In addition, for example, when a color image is recorded, if a background image is previously recorded in the region for recording the color image using the ink composition for a background image, it may be possible to improve the coloring property of the color image by overlaying the color image thereon.

1.2. Step of Attaching Ink Composition

The ink jet recording method of the present embodiment includes a step of attaching an ink composition to a recording medium. The ink composition to be attached to the recording medium by the ink jet recording method of the present embodiment may be a plurality of types, and it is possible to perform this step a plurality of times according to the number of ink compositions. A description will be given below of the ink composition and the attachment method thereof.

1.2.1. Ink Composition

The ink composition used in the ink jet recording method of the present embodiment may be, for example, a colored ink composition including a coloring material or a clear ink composition as described below. The ink composition used in the ink jet recording method of the present embodiment is a water-based ink composition, and includes a resin and an amide compound represented by General Formula (1) as an organic solvent.

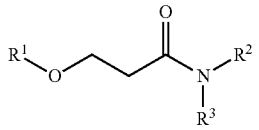

(1)

(In Formula (1), $R^1$ represents a linear or branched alkyl group having 1 to 6 carbon atoms; $R^2$ and $R^3$ represent each independently H or a linear or branched alkyl group having 1 to 4 carbon atoms.)

A water-based ink composition is a composition containing water as one of the main solvent components. Water may be included as the main solvent component of the water-based ink composition and is a component which is evaporated and scattered by drying. The water is preferably water obtained by removing ionic impurities as much as possible such as pure water or ultrapure water such as ion exchanged water, ultra-filtered water, reverse osmosis water, or distilled water. In addition, using water sterilized by addition of UV irradiation, hydrogen oxide, or the like makes it possible to suppress the generation of mold and bacteria in a case where the ink composition is stored for a long time, which is good. The content of water is preferably 45% by mass or more with respect to the total amount of the water-based ink composition, more preferably 50% by mass or more and 98% by mass or less, and even more preferably 55% by mass or more and 95% by mass or less.

1.2.1.1. Resin

The ink composition of the present embodiment contains a resin. Examples of the resin include resin particles and a dispersant resin for dispersing a coloring material in a case where a coloring material is contained in the ink composition. Resin particles are preferably included in view of excellent abrasion resistance and the like. Including the resin in the ink makes it possible to obtain recorded matter with excellent abrasion resistance and adhesion. In addition, in a case where the ink includes an organic solvent represented by General Formula (1), the organic solvent promotes dissolution of the resin, fixation of the ink to the recording medium is improved, and the abrasion resistance and adhesion are excellent.

Resin Particles

The resin particles have a function as a so-called fixing resin which improves the adhesion of the ink composition attached to the recording medium. Examples of such resin particles include resin particles formed of urethane-based resins, acrylic-based resins, styrene acrylic-based resins, fluorene-based resins, polyolefin-based resins, rosin modified-resins, terpene-based resins, polyester-based resins, polyamide-based resins, epoxy-based resins, vinyl chloride-based resins, vinyl chloride-vinyl acetate copolymers, ethylene vinyl acetate-based resins, and the like. These resin particles are often handled in the form of an emulsion, but may be in the form of a powder. In addition, the resin particles may be used alone or in a combination of two or more types thereof.

Urethane-based resin is a general term for resins having urethane bonds. Urethane-based resins which may be used include a polyether type urethane resin including an ether bond in the main chain in addition to the urethane bond, a polyester type urethane resin including an ester bond in the main chain, a polycarbonate type urethane resin including a carbonate bond in the main chain, and the like.

Acrylic-based resin is a general term for polymers obtained by polymerizing acrylic-based monomers such as (meth)acrylic acid and (meth)acrylic acid ester as at least one component, and examples thereof include resins obtained from acrylic-based monomers, copolymers of acrylic-based monomers and monomers other than the above, and the like. Examples thereof include acrylic-vinyl-based resins which are copolymers of an acrylic-based monomer and a vinyl-based monomer, and the like. Furthermore, examples thereof include copolymers with vinyl-based monomers such as styrene.

As the acrylic-based monomer, it is also possible to use acrylamide, acrylonitrile, and the like. Commercial products may be used as a resin emulsion with an acrylic-based resin as a raw material. In this specification, the acrylic-based resin may be a styrene acrylic-based resin described below. In the present specification, the expression (meth)acrylic means at least one of acrylic and methacrylic.

The styrene acrylic-based resin is a copolymer obtained from a styrene monomer and an acrylic-based monomer and examples thereof include a styrene-acrylic acid copolymer, a styrene-methacrylic acid copolymer, a styrene-methacrylic acid-acrylic acid ester copolymer, a styrene-α-methylstyrene-acrylic acid copolymer, a styrene-α-methylstyrene-acrylic acid-acrylic acid ester copolymer, and the like. A commercially available product may be used for the styrene acrylic-based resin. The styrene acrylic-based resin is one of the acrylic-based resins.

The polyolefin-based resin has an olefin such as ethylene, propylene, or butylene in the structural skeleton thereof, and it is possible to appropriately select and use known resins. As the olefin resin, a commercially available product may be used.

Examples of commercially available resin particle emulsions able to be used in the present embodiment are described below.

Styrene Acrylic-Based Resin Emulsion

Microgel E-1002 and E-5002 (product names, manufactured by Nippon Paint Co., Ltd.), Voncoat 5454 (product name, manufactured by DIC Corp.), Polysol AP-7020 and SAE 1014 (product names, manufactured by Showa Denko K.K.), Vinyblan 2586 (product name, manufactured by Nissin Chemical Co., Ltd.), Arrowbase CB-1200 and CD-1200 (product names, manufactured by Unitika Ltd.), Mowinyl 966A, 7320, and 975N (product names, manufactured by Nippon Synthetic Chemical Industry Co., Ltd.), Joncryl 62J, 7100, 390, 711, 511, 7001, 632, 741, 450, 840, 74J, HRC-1645J, 734, 852, 7600, 775, 537J, 1535, PDX-7630A, 352J, 352D, PDX-7145, 538J, 7640, 7641, 631, 790, 780, 7610, 2153, and 2350 (product names, manufactured by BASF Japan).

Acrylic-Based Resin Emulsion

Voncoat 4001 (product name, manufactured by DIC Corp.), Polysol AM-710, AM-920, AM-2300, AP-4735, AT-860, and PSASE-4210E (product names, manufactured by Showa Denko K.K.), Saivinol SK-200 (product name, manufactured by Saiden Chemical Industry Co., Ltd.), AE-120A (product name, manufactured by JSR Corp.), Vinyblan 2682 (product name, manufactured by Nissin Chemical Co., Ltd.), Mowinyl 952B, and 718A (product names, manufactured by Nippon Synthetic Chemical Industry Co., Ltd.), and NipolLX 852 and LX 874 (product names, manufactured by Zeon Corp.).

Urethane-Based Resin Emulsion

Superflex 870, 800, 150, 420, 460, 470, 610, 700, 460s, 840, and E-4000 (product names, manufactured by DKS Co., Ltd.), Permarin UA-150 (product name, manufactured by Sanyo Chemical Industries, Ltd.), SUNCURE 2710 (product name, manufactured by Japan Lubrizol Corp.), NeoRez R-9660, R-9637, and R-940 (product names, manufactured by Kusumoto Chemicals Ltd.), Adeka Bontighter HUX-380 and 290K (product names, manufactured by Adeka Corp.), Resamine D-1060, D-2020, D-4080, D-4200, D-6300, and D-6455 (product names, manufactured by Dainichiseika Color & Chemicals Mfg. Co., Ltd.), and Takelac W-6020, W-635, W-6061, W-605, W-635, W-6021, and W-512-A-6 (product names, manufactured by Mitsui Chemicals, Inc.).

Other Resin Emulsions

Elitel KA-5071 S, KT-8803, KT-9204, KT-8701, KT-8904, and KT-0507 (product names, manufactured by Unitika Ltd., polyester resin emulsion), High-tech SN-2002 (product name, manufactured by Toho Chemical Industry Co., Ltd., polyester resin emulsion), Polysol SH-502 (product name, manufactured by Showa Denko K.K., vinyl acetate resin emulsion), Polysol AD-13, AD-2, AD-10, AD-96, AD-17, and AD-70 (product names, manufactured by Showa Denko K.K., ethylene-vinyl acetate resin emulsion), Polysol PSASE-6010 (product name, manufactured by Showa Denko K.K., ethylene-vinyl acetate resin emulsion), AE 373 D (product name, manufactured by Emulsion Technology Co., Ltd., carboxy modified styrene•acryl resin emulsion), Seikadyne 1900W (product name, manufactured by Dainichiseika Color & Chemicals Mfg. Co., Ltd., ethylene-vinyl acetate resin emulsion), Vinyblan 2886 (product name, manufactured by Nissin Chemical Co., Ltd., vinyl acetate•acryl resin emulsion), Vinyblan 5202 (product name, manufactured by Nissin Chemical Co., Ltd., acetic acid acrylic resin emulsion), NK binder R-5HN (product name, manufactured by Shin-Nakamura Chemical Co., Ltd.), and Hydran WLS-210 (product name, manufactured by DIC Corp., non-cross-linkable polyurethane emulsion).

Physical Properties of Resin Particles

The glass transition temperature (Tg) of the resin particles is preferably −50° C. or higher to 200° C. or lower, more preferably 0° C. or higher to 150° C. or lower, and even more preferably 50° C. or higher to 100° C. or lower. When the glass transition temperature (Tg) of the resin particles is in the above range, the resin particles tend to be superior in durability and clogging resistance. It is possible to measure the glass transition temperature, for example, according to JIS K 7121 (method for measuring the transition temperature of plastics) using a differential scanning calorimeter "DSC 7000" manufactured by Hitachi High-Tech Science Corp.

The volume average particle diameter of the resin particles (before mixing with the aggregating agent) is preferably 10 nm or more and 300 nm or less, more preferably 50 nm or more and 250 nm or less, even more preferably 100 nm or more and 230 nm or less, and particularly preferably 150 nm or more and 210 nm or less. The volume average particle diameter of the resin particles is measured as an initial state by the method of confirming the volume average particle diameter of the resin particles described below. A case where the volume average particle diameter is in the above range is preferable in terms of the easy acquisition of the desired resin particles and easily obtaining preferable resin particle properties and the like.

The content of the resin particles in the ink composition with respect to the total mass of the ink composition is 0.1% by mass or more and 20% by mass or less as a solid content, preferably 1% by mass or more and 15% by mass or less, and more preferably 2% by mass or more and 10% by mass or less.

Dispersant Resin

In a case where the ink composition of the present embodiment contains a coloring material (particularly a water-insoluble pigment) described below, the coloring material may be dispersed by a dispersant resin. Such a dispersant resin may be included in the ink composition as a resin.

Examples of dispersant resins include polyvinyl alcohols, polyacrylic acid, acrylic acid-acryl nitrile copolymers, vinyl acetate-acrylic acid ester copolymers, acrylic acid-acrylic acid ester copolymers, styrene-acrylic acid copolymers, styrene-methacrylic acid copolymers, styrene-methacrylic acid-acrylic acid ester copolymers, styrene-α-methylstyrene-acrylic acid copolymers, styrene-α-methylstyrene-acrylic acid-acrylic acid ester copolymers, styrene-maleic acid copolymers, styrene-maleic anhydride copolymers, vinyl naphthalene-acrylic acid copolymers, vinyl naphthalene-maleic acid copolymers, vinyl acetate-maleic acid ester copolymers, vinyl acetate-crotonic acid copolymers, vinyl acetate-acrylic acid copolymers, and the like and salts thereof.

Preferable among these are a copolymer of a monomer having a hydrophobic functional group and a monomer having a hydrophilic functional group, and a polymer formed of a monomer having both a hydrophobic functional group and a hydrophilic functional group. As the form of the copolymer, it is possible to use any of a random copolymer, a block copolymer, an alternating copolymer, and a graft copolymer.

The dispersant resin described here has water solubility and has a function of improving the dispersibility of the pigment. The dispersant resin is common to the resin particles described above in terms of being formed of the resin, but differs in that the dispersant resin has water solubility and the resin particles become an emulsion in the ink composition.

It is possible to appropriately select the content ratio of the dispersant resin according to the pigment to be dispersed, but the content ratio is preferably 5 parts by mass or more and 200 parts by mass or less with respect to 100 parts by mass of the pigment content in the ink composition, and more preferably 20 parts by mass or more and 120 parts by mass or less.

The total content of the resin included the ink composition is 0.2% by mass or more and 22% by mass or less as solid content with respect to the total mass of the ink composition, more preferably 2% by mass or more and 15% by mass or less, and even more preferably 3% by mass or more and 10% by mass or less. In a case where the content of the resin is in the above range, the abrasion resistance, adhesion, and the like are excellent, which is preferable.

In addition, for example, in a case where the pigment is dispersed using a dispersant resin, if the content ratio of the resin combining the resin particles and the dispersant resin is in this range, it is possible for the fixing property of the ink composition to the recording medium to be sufficient, and it is possible to appropriately preserve the viscosity of the ink composition, for example, to suppress clogging of the ink jet head and the like.

1.2.1.2. Organic Solvent

The ink composition of the present embodiment includes an amide compound represented by General Formula (1) as an organic solvent.

Amide Compound (1)

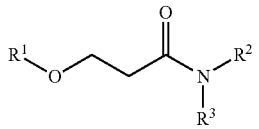

In Formula (1), $R^1$ represents an alkyl group having 1 to 4 carbon atoms, and $R^2$ and $R^3$ each independently represent a methyl group or an ethyl group. It is possible for the "alkyl group having 1 to 4 carbon atoms" to be a linear or branched alkyl group, and examples thereof include a methyl group, an ethyl group, an n-propyl group, an iso-propyl group, an n-butyl group, a sec-butyl group, an iso-butyl group, and a tert-butyl group. The amide compounds represented by Formula (1) may be used alone or in a combination of two or more types thereof.

Examples of the function of the amide compound represented by Formula (1) include improving the solubility of the resin, and improving the fixing property and abrasion resistance of the ink composition attached to the low-absorption recording medium. In particular, the amide compound represented by Formula (1) is excellent in the effect of moderately softening and dissolving the vinyl chloride-based resin. Therefore, the amide compound represented by Formula (1) is able to soften and dissolve the recording surface containing the vinyl chloride-based resin to allow the ink composition to permeate into the low-absorption recording medium. As the ink composition permeates into the low-absorption recording medium in this manner, the ink composition fixes firmly thereto and the surface of the ink composition dries easily. Accordingly, the obtained image tends to be excellent in the fixing property (abrasion resistance). In addition, it is possible to promote the dissolution of the resin included in the ink, and to improve the fixing property of the ink to the recording medium. On the other hand, in a case where the ink includes the amide compound represented by Formula (1), the lamination resistance tends to be inferior, but according to the recording method of the invention, it is possible for a recording method to also be excellent in lamination resistance.

In addition, in Formula (1), $R^1$ is more preferably a methyl group having 1 carbon atom. In Formula (1), the standard boiling point of the amide compound in which $R^1$ is a methyl group is lower than the standard boiling point of the amide compound in which $R^1$ is an alkyl group having 2 to 4 carbon atoms. Therefore, in Formula (1), when using an amide compound in which $R^1$ is a methyl group, it may be possible to improve the surface drying property of the attachment region (in particular, the surface drying property of the image in a case of being recorded in a high temperature and high humidity environment).

Examples of commercially available products of the amide compound represented by General Formula (1) include product name "Equamide M-100" (3-methoxy-N,N-dimethylpropionamide, manufactured by Idemitsu Kosan Co., Ltd., in the above General Formula, $R^1$ is a methyl group, $R^2$ is a methyl group, and $R^3$ is a methyl group), product name "Equamide B-100" (3-butoxy-N,N-dimethylpropionamide, manufactured by Idemitsu Kosan Co., Ltd., in the above General Formula, $R^1$: methyl group, $R^2$: methyl group, $R^3$: butyl group), and the like. One type may be used alone, or two or more types thereof may be used in a combination.

The content of the amide compound represented by Formula (1) with respect to the total mass of the ink composition is not particularly limited, but is preferably 1.0% by mass or more and 50.0% by mass or less, and more preferably 3.0% by mass or more and 35.0% by mass or less. Furthermore, the content is preferably 5.0% by mass or more and 30.0% by mass or less, more preferably 5.0% by mass or more and 25.0% by mass or less, even more preferably 6.0% by mass or more and 20.0% by mass or less, and particularly preferably 7.0% by mass or more and 18.0% by mass or less. When the content of the amide compound represented by Formula (1) is in the above range, it is possible to sufficiently obtain the image fixing property.

In a case where the ink composition includes an organic solvent other than the amide compound represented by Formula (1), the amide compound represented by Formula (1) is 25% by mass or more and 80% by mass or less of the total organic solvent included in the ink composition, preferably 30% by mass or more and 80% by mass or less, and more preferably 35% by mass or more and 50% by mass or less.

In addition, while the abrasion resistance of the image is improved as a result of the ink composition including the amide compound represented by Formula (1), the amide compound tends to remain in the recording medium since the standard boiling point of the amide compound represented by Formula (1) is relatively high. However, the recording method of the present embodiment includes a drying step, such that it is possible to increase the lamination resistance and blocking resistance even when the amide compound represented by Formula (1) is included.

Other Organic Solvents

The ink composition used in the ink jet recording method according to the present embodiment may contain a water-soluble organic solvent in addition to the above solvent. One of the functions of the water-soluble organic solvent is to improve the wettability of the ink composition with respect to the recording medium and to increase the moisture retention of the ink composition. Examples of water-soluble organic solvents include esters, alkylene glycol ethers, cyclic esters, nitrogen-containing solvents, polyhydric alcohols, and the like. Examples of nitrogen-containing solvents include cyclic amides and the like.

Examples of the esters include glycol monoacetates such as ethylene glycol monomethyl ether acetate, ethylene glycol monoethyl ether acetate, ethylene glycol monobutyl ether acetate, diethylene glycol monomethyl ether acetate, diethylene glycol monoethyl ether acetate, diethylene glycol monobutyl ether acetate, propylene glycol monomethyl ether acetate, dipropylene glycol monomethyl ether acetate, and methoxybutyl acetate; glycol diesters such as ethylene glycol diacetate, diethylene glycol diacetate, propylene glycol diacetate, dipropylene glycol diacetate, ethylene glycol acetate propionate, ethylene glycol acetate butyrate, diethylene glycol acetate butyrate, diethylene glycol acetate propionate, diethylene glycol acetate butyrate, propylene glycol acetate propionate, propylene glycol acetate butyrate, dipropylene glycol acetate butyrate, and dipropylene glycol acetate propionate.

The alkylene glycol ethers may be monoethers or diethers of alkylene glycols, and alkyl ethers are preferable. Specific examples thereof include alkylene glycol monoalkyl ethers such as ethylene glycol monomethyl ether, ethylene glycol monoethyl ether, ethylene glycol monoisopropyl ether, ethylene glycol monobutyl ether, diethylene glycol monomethyl ether, diethylene glycol monoethyl ether, diethylene glycol monobutyl ether, triethylene glycol monomethyl ether, triethylene glycol monoethyl ether, triethylene glycol monobutyl ether, tetraethylene glycol monomethyl ether, tetraethylene glycol monoethyl ether, tetraethylene glycol monobutyl ether, propylene glycol monomethyl ether, propylene glycol monoethyl ether, propylene glycol monopropyl ether, propylene glycol monobutyl ether, dipropylene glycol monomethyl ether, dipropylene glycol monoethyl ether, dipropylene glycol monopropyl ether, dipropylene glycol monobutyl ether, and tripropylene glycol monobutyl ether, and alkylene glycol dialkyl ethers such as ethylene glycol dimethyl ether, ethylene glycol diethyl ether, ethylene glycol dibutyl ether, diethylene glycol dimethyl ether, diethylene glycol diethyl ether, diethylene glycol dibutyl ether, diethylene glycol methyl ethyl ether, diethylene glycol methyl butyl ether, triethylene glycol dimethyl ether, triethylene glycol diethyl ether, triethylene glycol dibutyl ether, triethylene glycol methyl butyl ether, tetraethylene glycol dimethyl ether, tetraethylene glycol diethyl ether, tetraethylene glycol dibutyl ether, propylene glycol dimethyl ether, propylene glycol diethyl ether, dipropylene glycol dimethyl ether, dipropylene glycol diethyl ether, and tripropylene glycol dimethyl ether.

In addition, for the alkylene glycols, diethers make the resin particles in the ink composition dissolve or swell more easily than monoethers and are more preferable from the viewpoint of improving the abrasion resistance of the formed image.

Examples of cyclic esters include cyclic esters (lactones) such as β-propiolactone, γ-butyrolactone, δ-valerolactone, ε-caprolactone, β-butyrolactone, β-valerolactone, γ-valerolactone, β-hexanolactone, γ-hexanolactone, δ-hexanolactone, β-heptanolactone, γ-heptanolactone, δ-heptanolactone, ε-heptanolactone, γ-octanolactone, δ-octanolactone, ε-octanolactone, δ-nonalactone, ε-nonalactone, and ε-decanolactone, and compounds in which the hydrogen of the methylene group adjacent to the carbonyl group is substituted with an alkyl group having 1 to 4 carbon atoms.

Examples of the cyclic amides include lactams, and examples thereof include pyrrolidones such as 2-pyrrolidone, 1-methyl-2-pyrrolidone, 1-ethyl-2-pyrrolidone, 1-propyl-2-pyrrolidone, 1-butyl-2-pyrrolidone, and the like. These are preferable from the viewpoint of promoting film formation with the resin particles, and 2-pyrrolidone is more preferable.

Examples of polyhydric alcohols include 1,2-alkanediols (for example, alkanediols such as ethylene glycol, propylene glycol (other name: propane-1,2-diol), 1,2-butanediol, 1,2-pentanediol, 1,2-hexanediol, 1,2-heptanediol, and 1,2-octanediol), polyhydric alcohols (polyols) other than 1,2-alkanediol (for example, diethylene glycol, dipropylene glycol, 1,3-propanediol, 1,3-butanediol (other name: 1,3-butylene glycol), 1,4-butanediol, 1,5-pentanediol, 1,6-hexanediol, 2-ethyl-2-methyl-1,3-propanediol, 2-methyl-2-propyl-1,3-propanediol, 2-methyl-1,3-propanediol, 2,2-dimethyl-1,3-propanediol, 3-methyl-1,3-butanediol, 2-ethyl-1,3-hexanediol, 3-methyl-1,5-pentanediol, 2-methyl pentane-2,4-diol, trimethylolpropane, glycerine, and the like) and the like.

It is possible to divide polyhydric alcohols into alkanediols and polyols. Alkanediols are diols of alkanes having 5 or more carbon atoms. The number of carbon atoms of the alkane is preferably 5 to 15, more preferably 6 to 10, and even more preferably 6 to 8. 1,2-alkanediol is preferable.

Polyols are polyols of alkanes having 4 or less carbon atoms or intermolecular condensates of hydroxyl groups of polyols of alkanes having 4 or less carbon atoms. The number of carbon atoms of the alkane is preferably 2 to 3. The number of hydroxyl groups in the molecule of the polyols is 2 or more, preferably 5 or less, and more preferably 3 or less. In a case where the polyols are the intermolecular condensate described above, the intermolecular condensation number is 2 or more, preferably 4 or less, and more preferably 3 or less. It is possible to use the polyhydric alcohols alone or in a combination of two or more types.

It is possible for alkanediols and polyols to mainly function as penetrating solvents and/or moisturizing solvents. However, alkanediols tend to have strong properties as a penetrating solvent, and polyols tend to have strong properties as a moisturizing solvent.

The standard boiling points of some polyhydric alcohols are listed. 1,2-butanediol [194° C.], 1,2-pentanediol [210° C.], 1,2-hexanediol [224° C.], 1,2-heptanediol [227° C.], 1,3-propanediol [210° C.], 1,3-butanediol [230° C.], 1,4-butanediol [230° C.], 1,5-pentanediol [242° C.], 1,6-hexanediol [250° C.], 2-ethyl-2-methyl-1,3-propanediol [226° C.], 2-methyl-2-propyl-1,3-propanediol [230° C.], 2-methyl-1,3-propanediol [214° C.], 2,2-dimethyl-1,3-propanediol [210° C.], 3-methyl-1,3-butanediol [203° C.], 2-ethyl-1,3-hexanediol [244° C.], 3-methyl-1,5-pentanediol [250° C.], 2-methylpentane-2,4-diol [197° C.], diethylene glycol [245° C.], dipropylene glycol [232° C.], triethylene glycol [287° C.], and glycerin [290° C.].

In a case where a water-soluble organic solvent is used, one type may be used alone, or a combination of two or more types may be used. In addition, the total content of the organic solvent including the organic solvent represented by General Formula (1) with respect to the total mass of the ink composition is, for example, 5% by mass or more and 50% by mass or less, preferably 10% by mass or more and 45% by mass or less, more preferably 15% by mass or more and 40% by mass or less, and even more preferably 20% by mass or more and 40% by mass or less. When the content of the organic solvent is in the above range, the balance between the wetting and spreading property and the drying property is further improved, and it is easy to form a high-quality image.

In the ink composition, the content of the polyol organic solvent which is a liquid in an environment of 25° C. and which has a standard boiling point exceeding 280° C. is preferably 5.0% by mass or less with respect to the total mass of the ink composition. The content is more preferably 3.0% by mass or less, even more preferably 1.0% by mass or less, particularly preferably 0.5% by mass or less, and more particularly preferably 0.1% by mass or less. The lower limit of the content is 0% by mass or more and the organic solvent may not be included. This makes it possible to make the drying property of the ink composition attached to the recording medium better and improve the adhesion of the ink composition to the recording medium. Furthermore, in the ink composition, the content of an organic solvent (not limited to polyols) which is a liquid in an environment of 25° C. and which has a standard boiling point exceeding 280° C. is more preferably in the above range with respect to the total mass of the ink composition in view of the above points. Examples of the organic solvent having a standard boiling point exceeding 280° C. include glycerin, polyethylene glycol monomethyl ether, and the like. In a case where such a high boiling point solvent is included in a predetermined amount or more, the ink composition does not easily evaporate, and an excessive temperature and time may be necessary in the drying step. In addition, the high-boiling point solvent tends to remain without evaporation, the evaporation takes time, and the film formation of the resin does not proceed sufficiently, thus, the durability is lowered. From this point too, a high-boiling point solvent is preferably not included.

In addition, from the viewpoint of the drying property of the image, in a case where the ink composition includes a water-soluble organic solvent, any one of polyols, alkanediols, and glycol ethers having a standard boiling point of 280° C. or lower is preferably included as the organic solvent.

In addition, in a case where the ink composition includes a nitrogen-containing solvent, the content thereof is preferably 1.0% by mass or more and 25.0% by mass or less from the viewpoint of superior abrasion resistance and the like, more preferably 5.0% by mass or more and 23.0% by mass or less, even more preferably 7.0% by mass or more and 20.0% by mass or less, and particularly preferably 11.0% by mass or more and 17.0% by mass or less.

Furthermore, in a case where the ink composition includes a polyhydric alcohol, the content thereof is preferably 1.0% by mass or more and 27.0% by mass or less from the viewpoint of superior abrasion resistance and the like, more preferably 5.0% by mass or more and 15.0% by mass or less, and even more preferably 7.0% by mass or more and 13.0% by mass or less.

1.2.1.3. Other Components

The ink composition of the present embodiment may contain components such as a coloring material, a surfactant, an additive, and the like. In a case where the ink composition is not a colored ink composition, the ink composition may be a clear ink composition.

Coloring Material

The ink composition of the present embodiment may further include a coloring material. When the ink composition according to the present embodiment includes a coloring material, use is possible as a colored ink composition. The colored ink composition is an ink composition used for coloring a recording medium. It is possible to use at least one of a pigment and a dye as the coloring material.

Pigment

Using a pigment as a coloring material makes it possible to improve the light resistance of the ink composition. As the pigment, it is possible to use either an inorganic pigment or an organic pigment. Examples of pigments able to be used as these pigments include colored pigments such as cyan, yellow, magenta, and black, and special pigments such as white pigments and bright pigments.

Examples of organic pigments include quinacridone-based pigments, quinacridone quinone-based pigments, dioxane-based pigments, dioxazine-based pigments, phthalocyanine-based pigments, anthrapyrimidine-based pigments, anthanthrone-based pigments, indanthrone-based pigments, flavanthrone-based pigments, perylene-based pigments, diketopyrrolopyrrole-based pigments, perinone-based pigments, quinophthalone-based pigments, anthraquinone-based pigments, thioindigo-based pigments, benzimidazolone-based pigments, thioindigo-based pigments, isoindolinone-based pigments, azomethine-based pigments, dye chelates, dye lakes, nitro-based pigments, nitroso-based pigments, aniline black, and azo-based pigments such as insoluble azo pigments, condensed azo pigments, azo lakes, and chelate azo pigments, and the like.

Specific examples of the organic pigment include the following.

Examples of cyan pigments include C.I. Pigment Blue 1, 2, 3, 15:3, 15:4, 16, 22, 60, and the like; C.I. Vat Blue 4, 60, and the like, and one selected from a group formed of C.I. Pigment Blue 15:3, 15:4, and 60, or a mixture of two or more types thereof is preferable.

Examples of magenta pigments include C.I. Pigment Red 5, 7, 12, 48 (Ca), 48 (Mn), 57 (Ca), 57:1, 112, 122, 123, 168, 184, 202, and 209; C.I. Pigment Violet 19 and the like, and one selected from a group formed of C.I. Pigment Red 122, 202, and 209, and C.I. Pigment Violet 19, or a mixture of two or more types thereof is preferable.

Examples of yellow pigments include C.I. Pigment Yellow 1, 2, 3, 12, 13, 14 C, 16, 17, 73, 74, 75, 83, 93, 95, 97, 98, 109, 110, 114, 128, 129, 138, 150, 151, 154, 155, 180, 185, and the like, and one selected from a group formed of C.I. Pigment Yellow 74, 109, 110, 128, and 138, or a mixture of two or more types thereof is preferable.

Examples of orange pigments include C.I. Pigment Orange 36 or 43 or a mixture thereof.

Examples of green pigments include C.I. Pigment Green 7 or 36 or a mixture thereof.

Examples of black pigments include furnace black, lamp black, acetylene black, channel black (C.I. Pigment Black 7), and the like, and commercially available products such as No. 2300, 900, MCF88, No. 20B, No. 33, No. 40, No. 45, No. 52, MA7, MA8, MA100, No 2200B, and the like (product names, manufactured by Mitsubishi Chemical Corp.), Color black FW 1, FW 2, FW 2 V, FW 18, FW 200, S150, S160, S170, Printex 35, U, V, 140U, Special black 6, 5, 4A, 4, 250, and the like (product names, manufactured by Degussa), Conductex SC, Raven 1255, 5750, 5250, 5000, 3500, 1255, 700, and the like (the above are all product names, manufactured by Nippon Carbon Co., Ltd.), Regal 400R, 330R, 660R, Mogul L, Monarch 700, 800, 880, 900, 1000, 1100, 1300, 1400, Elftex 12, and the like (product names, manufactured by Cabot Corp.). These carbon blacks may be used alone or as a mixture of two or more types.

The bright pigment is not particularly limited as long as it is able to exhibit brilliance when attached to a medium, and examples thereof include metal particles selected from the group formed of aluminum, silver, gold, platinum, nickel, chromium, tin, zinc, indium, titanium, and copper, or alloys of two or more types thereof (also referred to as metal pigments) or pearl pigments having a pearly gloss. Representative examples of pearl pigments include pigments having pearly gloss and interference gloss such as titanium dioxide-coated mica, fish scale foil, and bismuth oxychloride. In addition, the bright pigment may be subjected to a surface treatment for suppressing a reaction with water.

In addition, examples of white pigments include metal compounds such as metal oxides, barium sulfate, and calcium carbonate. Examples of metal oxides include titanium dioxide, zinc oxide, silica, alumina, magnesium oxide, and the like. In addition, particles having a hollow structure may be used for the white pigment.

These pigments may be used alone or in a combination of two or more types thereof. The pigment is preferably an organic pigment from the viewpoint of storage stability such as light resistance, weather resistance, and gas resistance.

The volume-based average particle diameter (D50) of the pigment (also referred to as "volume average particle diameter") (before mixing the treatment liquid) is preferably 10 nm or more and 200 nm or less, more preferably 30 nm or more and 170 nm or less, even more preferably 50 nm or more and 150 nm or less, and particularly preferably 70 nm or more and 120 nm or less. When the volume average particle diameter is in this range, it is easy to acquire the pigment and to obtain preferable properties. In addition, when the volume average particle diameter of the pigment is in the above range, it is difficult for the pigment particles to settle and it is possible to improve the dispersion stability, in addition, when applied to an ink jet recording apparatus, it is possible to make nozzle clogging and the like less likely to occur. In addition, when the volume average particle diameter of the pigment is in the above range, it is possible to have a sufficiently satisfactory color density in the image.

It is possible to measure the volume average particle diameter of the pigment with a particle size distribution measuring apparatus using the laser diffraction scattering method as the measurement principle. Examples of particle size distribution measuring apparatuses include a particle size distribution meter (for example, "Microtrac UPA" manufactured by Nikkiso Co., Ltd.) using the dynamic light scattering method as the measurement principle.

The pigment is preferably able to stably disperse in the ink. For example, by using ozone, hypochlorous acid, fuming sulfuric acid, or the like, the pigment surface may be oxidized or sulfonated to modify the surface of the pigment particles, such that the pigment may be used as a self-dispersing type pigment or may be used after being dispersed using a resin dispersant.

Dye

Dyes may be used as coloring materials. The dye is not particularly limited, and it is possible to use acid dyes, direct dyes, reactive dyes, and basic dyes. Examples of dyes include C.I. Acid Yellow 17, 23, 42, 44, 79, 142, C.I. Acid Red 52, 80, 82, 249, 254, 289, C.I. Acid Blue 9, 45, 249, C.I. Acid Black 1, 2, 24, 94, C.I. Food Black 1, 2, C.I. Direct Yellow 1, 12, 24, 33, 50, 55, 58, 86, 132, 142, 144, 173, C.I. Direct Red 1, 4, 9, 80, 81, 225, 227, C.I. Direct Blue 1, 2, 15, 71, 86, 87, 98, 165, 199, 202, C.I. Direct black 19, 38, 51, 71, 154, 168, 171, 195, C.I. Reactive Red 14, 32, 55, 79, 249, C.I. Reactive Black 3, 4, and 35. One type of these dyes may be used alone, or a combination of two or more types thereof may be used.

The total content of the coloring material is preferably 1% by mass or more and 20% by mass or less with respect to the total mass (100% by mass) of the ink composition. The coloring material may be a clear composition (clear ink) including no coloring material or containing a coloring material to such an extent that coloring is not intended to occur (for example, 0.1% by mass or less).

Surfactant

The ink composition may contain a surfactant. The surfactant has a function of lowering the surface tension of the ink composition and improving the wettability with the recording medium. Among surfactants, for example, it is possible to preferably use acetylene glycol-based surfactants, silicone-based surfactant, and fluorine-based surfactant.

The acetylene glycol-based surfactant is not particularly limited, but examples thereof include Surfynol 104, 104E, 104H, 104A, 104BC, 104DPM, 104PA, 104PG-50, 104S, 420, 440, 465, 485, SE, SE-F, 504, 61, DF 37, CT 111, CT 121, CT 131, CT 136, TG, GA, and DF 110 D (the above are all product names, manufactured by Air Products & Chemicals, Inc.), Olfine B, Y, P, A, STG, SPC, E1004, E1010, PD-001, PD-002W, PD-003, PD-004, EXP. 4001, EXP. 4036, EXP. 4051, AF-103, AF-104, AK-02, SK-14, and AE-3 (the above are all product names, manufactured by Nissin Chemical Co., Ltd.), Acetylenol E00, EOOP, E40, and E100 (the above are all product names, manufactured by Kawaken Fine Chemicals Co., Ltd.).

The silicone-based surfactant is not particularly limited and preferable examples thereof include polysiloxane-based compounds. The polysiloxane-based compound is not particularly limited, and examples thereof include a polyether-modified organosiloxane. Examples of commercially available products of the polyether-modified organosiloxane include BYK-306, BYK-307, BYK-333, BYK-341, BYK-345, BYK-346, and BYK-348 (product names, manufactured by BYK Japan), KF-351A, KF-352A, KF-353, KF-354L, KF-355A, KF-615A, KF-945, KF-640, KF-642, KF-643, KF-6020, X-22-4515, KF-6011, KF-6012, KF-6015, and KF-6017 (the above are all product names, manufactured by Shin-Etsu Chemical Co., Ltd.).

As the fluorine-based surfactant, it is preferable to use fluorine-modified polymers, and specific examples thereof include BYK-3440 (manufactured by BYK Japan), Surflon S-241, S-242, and S-243 (product names, manufactured by AGC Seimi Chemical Co., Ltd.), Futagent 215 M (manufactured by Neos Corp.), and the like.

In a case where a surfactant is contained in the ink composition, a plurality of types may be contained. In a case where the surfactant is contained in the ink composition, the content is 0.1% by mass or more and 1.5% by mass or less with respect to the total mass of the ink composition, preferably 0.2% by mass or more and 1.0% by mass or less, and more preferably 0.3% by mass or more and 0.8% by mass or less.

Additives

As additives, the ink composition may include ureas, amines, saccharides, and the like. Since the wax has a function of imparting lubrication to the image formed by the ink composition, it is possible to reduce peeling of images due to the ink composition and the like. As waxes, it is possible to use, for example, plant-animal waxes such as carnauba wax, candeli wax, beeswax, rice wax, and lanolin; petroleum waxes such as paraffin wax, microcrystalline wax, polyethylene wax, oxidized polyethylene wax, and petrolatum; mineral waxes such as montan wax and ozocerite; synthetic waxes such as carbon wax, Hoechst wax, polyolefin wax, and stearic acid amide, natural/synthetic wax emulsion or blended wax such as an α-olefin/maleic anhydride copolymer, alone or in a mix of a plurality of types thereof. Among these, polyolefin wax (particularly, polyethylene wax and polypropylene wax) and paraffin wax are preferably used from the viewpoint of being superior in the effect of improving the fixing property to a soft packaging film described below.

As waxes, it is also possible to use commercially available products as they are and examples thereof include Nopcoat PEM-17 (product name, manufactured by San Nopco Limited), Chemipearl W4005 (product name, manufactured by Mitsui Chemicals, Inc.), AQUACER 515, 539, and 593 (the above are product names, manufactured by BYK Japan K.K.), and the like.

In the drying step (heating step) in the recording method, from the viewpoint of suppressing the wax from being excessively melted and the performance thereof from being decreased, it is preferable to use a wax for which the melting point of the wax is preferably 50° C. or higher and 200° C. or lower, the melting point is more preferably 70° C. or higher to 180° C. or lower, and the melting point is even more preferably 90° C. or higher to 150° C. or lower.

The wax may be supplied in the form of an emulsion or a suspension. In a case of containing a wax, the content is 0.1% by mass or more and 10% by mass or less in terms of solid content with respect to the total mass of the ink composition, more preferably 0.5% by mass or more and 5% by mass or less, and even more preferably 0.5% by mass or more and 2% by mass or less. When the content of the wax is in the above range, it is possible for the function of the wax to be exhibited satisfactorily.

Examples of ureas include urea, ethyleneurea, tetramethylurea, thiourea, 1,3-dimethyl-2-imidazolidinone, and the like, and betaines (trimethylglycine, triethylglycine, tripropylglycine, triisopropylglycine, N,N,N-trimethylalanine, N,N,N-triethylalanine, N,N,N-triisopropylalanine, N,N,N-trimethylmethylalanine, carnitine, acetylcarnitine, and the like), and the like.

Examples of the amines include diethanolamine, triethanolamine, triisopropanolamine, and the like. Ureas and amines may function as pH adjusting agents.

Examples of saccharides include glucose, mannose, fructose, ribose, xylose, arabinose, galactose, aldonic acid, glucitol (sorbit), maltose, cellobiose, lactose, sucrose, trehalose, maltotriose, and the like.

Others

As necessary, the ink according to the present embodiment may further include components such as an anti-septic/mildewproofing agent, a rust preventive agent, a chelating agent, a viscosity modifier, an anti-oxidant, and a preservative.

1.2.2. Physical Properties of Ink Composition

In the present embodiment, in a case where a step of attaching an ink composition is performed, from the viewpoint of making the wetting and spreading property on the recording medium appropriate, the surface tension at 25° C. is 40 mN/m or less, preferably 38 mN/m or less, more preferably 35 mN/m or less, and even more preferably 30 mN/m or less.

The ink composition is attached to the recording medium by an ink jet method. Therefore, the viscosity at 20° C. is preferably 1.5 mPa·s or more and 15 mPa·s or less, more preferably 1.5 mPa·s or more and 5 mPa·s or less, and even more preferably 1.5 mPa·s or more and 3.6 mPa·s or less. The ink composition is attached to the recording medium by an ink jet method, and it is easy to efficiently form a predetermined image on a recording medium.

1.2.3. Method of Attaching Ink Composition to Recording Medium

The recording method of the present embodiment includes a step of attaching an ink composition to a recording region of a recording medium. The ink composition to be attached to the recording medium by the recording method of the present embodiment may be a plurality of types, and it is possible to perform this step a plurality of times according to the number of ink compositions.

It is possible to perform the step of attaching an ink composition of the recording method according to the present embodiment to a recording medium using an ink jet recording apparatus having a recording head (ink jet head). A description will be given of an ink jet recording apparatus which is able to be used for the recording method according to the present embodiment.

1.2.3.1. Ink Jet Recording Apparatus

It is possible to use either a serial type or line type ink jet recording apparatus. In these types of ink jet recording apparatuses, a recording head is mounted, and droplets of the ink composition are ejected from the nozzle holes of the recording head at a predetermined timing and at a predetermined volume (mass) while changing the relative positional relationship between the recording medium and the recording head, and it is possible to form a predetermined image by attaching a treatment liquid or an ink composition to the recording medium.

For the ink jet recording apparatus used in the present embodiment, it is possible to arbitrarily adopt a known configuration such as a drying unit, a roll unit, or a winding apparatus. In addition, it is possible for the ink jet recording apparatus to have a transport means for transporting a recording medium, an image layer forming means for recording an image using a treatment liquid or an ink composition, a drying means, a whole apparatus drying means for heating and blowing the recording surface, and the like.

It is possible to form the transport means by, for example, a roller. The transport means may have a plurality of rollers. As long as it is possible to transport the recording medium, the position and the number of the transport means to be provided are arbitrary. The transport means may be provided with a paper feed roll, a paper feed tray, a paper discharge roll, a paper ejecting tray, various platens, and the like.

The image layer forming means records the image layer by ejecting the treatment liquid or the ink composition of the present embodiment onto the recording surface of the recording medium. The image layer forming means is provided with a recording head provided with nozzles, and the recording heads may be different for each composition, or a nozzle row may be assigned for each composition.

It is possible to use the drying means for drying the image layer formed on the recording surface or for removing volatile components on the recording medium. The drying means may be provided at any position in consideration of the timing of the attaching step, the transport path of the recording medium and the like, and may be provided in any number. As the image layer drying means, it is possible to use a method of applying heat to the recording medium by transferring heat from a member in contact with the recording medium, such as platen heating, a blowing method of blowing air onto the image on the recording medium or blowing air over the recording region of the recording medium to promote drying, a radiation method of irradiating the recording medium with radiation emitting heat, or the like. Further examples thereof include a method combining the above. Specifically, the means used in these methods may be forced air heating, radiation heating, conductive heating, high frequency drying, microwave drying, or the like.

In the step of attaching an ink composition, it is possible to perform the drying of the ink as necessary. The temperature of the recording medium reached by heating in such a case is, for example, 20° C. or higher and 70° C. or lower, preferably 20° C. or higher and 60° C. or lower, more preferably 25° C. or higher and 50° C. or lower, even more preferably 30° C. or higher and 40° C. or lower, and particularly preferably 32° C. or higher and 38° C. or lower. In a case of using a treatment liquid, the drying of the treatment liquid and the colored ink composition may be performed simultaneously.

A description will be given of an example of an ink jet recording apparatus able to be used in the present embodiment with reference to the drawings. FIGURE is a schematic sectional view schematically showing an ink jet recording apparatus. As shown in FIGURE, the ink jet recording apparatus 1 is provided with an ink jet head 2, an IR heater 3, a platen heater 4, a curing heater 5, a cooling fan 6, a preheater 7, and a blower fan 8. The ink jet recording apparatus 1 is provided with a control unit (not shown), and the operation of the entire ink jet recording apparatus 1 is controlled by the control unit.

The ink jet head 2 is means for ejecting and attaching the ink composition and treatment liquid to the recording medium M. In the ink attaching step, the drying of ink or the like attached to the recording medium is promoted by an IR heater, a platen heater, or a blower fan. The recording medium after the ink attaching step is subjected to a post-heating step performed by a curing heater. The curing heater may be a radiation type or a blowing type. In addition, a heat transfer type curing heater may be provided in the lower part of the recording medium below the curing heater.

The ink jet head 2 may be a serial type which is mounted on a carriage (not shown) and which ejects ink while moving in the front to back direction of the diagram. Alternatively, the ink jet head 2 may be a line type which is a line head which extends in the front to back direction of the diagram and has a fixed position during recording and which discharges ink while transporting the recording medium.

1.2.3.2. Attachment Amount

Since the ink jet recording method of the present embodiment has a drying step to be described below, it is possible to increase the attachment amount of the ink composition in the attaching step. In addition, since there is a drying step, it is possible to increase the amount of the organic solvent included in the ink composition.

Specifically, in the recording region of the recording medium to which the ink composition is attached, it is possible to form a region in which the attachment amount of the ink composition is 5.0 mg/inch$^2$ or more and 30.0 mg/inch$^2$ or less. From the viewpoint of being able to have both a coloring property and durability, it is more preferable to form a region in which the attachment amount of the ink composition is 9.0 mg/inch$^2$ or more and 25 mg/inch$^2$ or less, and even more preferable to have a region with 10.0 mg/inch$^2$ or more and 22 mg/inch$^2$ or less. In addition, the lower limit of the attachment amount of the ink composition in the recording region is preferably, in order of preference, 7.0 mg/inch$^2$, 8.0 mg/inch$^2$, 10.0 mg/inch$^2$, 15.0 mg/inch$^2$, 17.0 mg/inch$^2$, and 20.0 mg/inch$^2$, and the upper limit is preferably, in order of preference, 50.0 mg/inch$^2$, 35.0 mg/inch$^2$, 30.0 mg/inch$^2$, and 25.0 mg/inch$^2$ or more.

In a case where the attachment amount of the ink composition is large, it is useful in that it is possible to record a high-density image and, in general, the abrasion resistance is excellent, but, on the other hand, the remaining amount of the solvent tends to increase in particular. Therefore, the durability tends to be lowered; however, since the recording method of the present embodiment has a drying step to be described below, it is possible to obtain sufficient durability. That is, the recording method of the present embodiment produces a more remarkable effect in a case where the attachment amount of the ink composition is large.

The expression including at least a region with a specific attachment amount does not prevent the provision of another region having a different attachment amount, but the region with the maximum attachment amount is preferably the region with the specific attachment amount.

1.3. Drying Step of Heating Recording Medium to which Ink Composition is Attached The ink jet recording method of the present embodiment is provided with a step (post-heating step) of heating the recording medium after the step of attaching an ink composition to the recording medium. It is possible for the ink jet recording apparatus to perform the step of heating the recording medium, for example, using a whole apparatus drying means, or the like. In addition, without being limited to the ink jet recording apparatus, it is possible to perform the step after the recording with an appropriate drying means, such as using another apparatus. As a drying means, it is preferable to use one or more types of radiation, blowing, and heat transfer. In addition, the air may be blown as warm air or blown at room temperature. Radiation and blowing are preferable from the viewpoint of excellent drying efficiency.

In the ink jet recording method of the present embodiment, the obtained image is dried by a drying step of heating the recording medium to which the ink composition is attached, and the organic solvent remaining in the recording region is dried to 2.0 mg/inch$^2$ or less. The recording region is a region to which a water-based ink composition including an amide compound represented by the above General Formula (1) is attached. The organic solvent remaining in the recording region is preferably 1.5 mg/inch$^2$ or less, more preferably 1.0 mg/inch$^2$ or less, even more preferably 0.5 mg/inch$^2$ or less, and particularly preferably 0.3 mg/inch$^2$ or less. In addition, the organic solvent remaining in the recording region is 0.05 mg/inch$^2$ or more and 2.0 mg/inch$^2$ or less, and more preferably set to be 0.1 mg/inch$^2$ or more and 2.0 mg/inch$^2$ or less. The remaining amount of the organic solvent in the recording region is dried so as to be in the above range regardless of the attachment amount of the ink composition or the like. In addition, the recording region is a region to which at least the water-based ink composition including the amide compound represented by General Formula (1) is attached, and the region is dried so as to be in the above range regardless of the attachment of the composition other than this.

Thus, since it is possible to more sufficiently dry the recorded matter, for example, in the case of laminating an image, it is possible to suppress the generation of bubbles in the laminate and to suppress the generation of irregularities in the recorded matter. In addition, carrying out the drying sufficiently makes it possible to more sufficiently fix the ink composition, for example, making it possible to set the recorded matter to an immediately usable state. Furthermore, it is possible to sufficiently evaporate the amide compound represented by the above General Formula (1), and to have both abrasion resistance and lamination resistance in the image.

A test in a case where resistance to lamination is required for the durability of the image will be more rigorous than a general dryness test and abrasion resistance test since peeling or irregularities may occur in the laminate film due to the remaining organic solvent.

In a case where a plurality of recorded matter are stacked and left to stand, it is possible to make the blocking resistance excellent such that it is possible to reduce the sticking of the recorded matter and the peeling of the recording surface. In addition, when the remaining amount of the organic solvent is the above range or more, it is possible to reduce excessive time being required for the heating step and to reduce thermal damage being applied to the recording medium due to an excessive heating temperature, which is preferable.

More specifically, the temperature of the recording medium reached by heating in this step is 70° C. or higher and 120° C. or lower, preferably 80° C. or higher and 100° C. or lower, and more preferably 90° C. or higher and 100° C. or lower. When the temperature of the recording medium is in this range, the organic solvent remaining in the recording region is easily set to 0.05 mg/inch$^2$ or more and 2.0 mg/inch$^2$ or less and it is possible to perform film formation and flattening with the resin particles included in the recorded matter.

By controlling the heating conditions such as heating temperature and heating time in this step, the remaining amount of organic solvent may be measured, and the remaining amount of the organic solvent may be adjusted to 2.0 mg/inch$^2$ or less.

It is possible to measure the remaining amount of the organic solvent in the recording region using thermogravimetric analysis (TG). In addition, it is possible to specify the type of solvent remaining at the temperature at the time of mass reduction. Furthermore, it is also possible to specify the solvent type by mass spectrometry of the gas volatilized at the same time by thermogravimetric mass spectrometry (TG-MS). For the sample in this case, it is assumed that deposits of the ink composition are collected from the recorded matter. This measurement test is carried out after leaving the sample for 1 hour after returning to room temperature after the drying step is completed.

As the base material used in the measurement test, heat-drying is carried out on the base material alone under the same conditions as the recording method, and it is confirmed beforehand that no organic solvent coming from the base material is detected in the base material itself, such that the recording may be performed using the base material and measurement may be performed. In addition, in a case where an organic solvent coming from the base material itself is detected in the base material, the amount of the organic solvent may be determined by subtracting the detected content. Preferably, considering the above points, the measurement test is performed using the same type of base material as the base material (recording medium) to be used when performing the actual recording method.

When the predetermined remaining amount of the organic solvent is confirmed in the measurement test, if recording is performed under the same conditions as the recording performed in the measurement test when the actual recording method is performed, it is considered that it is possible to perform the recording method satisfying these measurement results. In other words, if recording is performed under the same conditions as the recording conditions for performing the actual recording method and the measurement test is performed, it is possible to confirm the remaining amount of the organic solvent in the recording method.

In this step, water may be evaporated prior to the organic solvent. In such a case, the remaining amount of water after this step is almost zero. However, there may be cases where a small amount of water remains. The water remaining in the recording region is preferably dried so as to be 0.2 mg/inch$^2$ or less, more preferably 0.1 mg/inch$^2$ or less, and even more preferably 0.05 mg/inch$^2$ or less. The lower limit of the remaining amount of water is 0 mg/inch$^2$ or more.

1.4. Other Steps

Lamination Step

The recording method of the present embodiment may include a step of laminating a recording medium (recorded matter) after the post-heating step. A laminate is obtained by performing lamination as described below.

It is possible to further add other steps to the ink jet recording method of the present embodiment as appropriate, for example, a step of attaching a treatment liquid to the recording medium, a step of attaching a clear ink to the recording medium, and the like.

1.4.1. Step of Attaching Treatment Liquid to Recording Medium

In a case where the ink jet recording method of the present embodiment includes a step of attaching a treatment liquid to the recording medium, it is possible to fix the ink composition quickly using a treatment liquid, thus, it is possible to improve the image quality even without raising the heating temperature in the step of attaching an ink composition. This is advantageous in that the ejection stability of the head is improved. In addition, in a case of using a treatment liquid, since the solid-liquid separation of the ink composition occurs quickly, it is considered that the evaporation of the organic solvent of the ink composition proceeds quickly and there is a tendency for the remaining amount to be a predetermined amount or less.

The treatment liquid used in the ink jet recording method of the present embodiment contains an aggregating agent for aggregating components of the ink composition.

1.4.1.1. Aggregating Agent

The treatment liquid contains an aggregating agent for aggregating the components of the ink composition. The aggregating agent has an effect of aggregating a coloring material and resin particles by reacting with components such as the coloring materials included in the ink composition and resin particles included in the ink composition. However, the degree of aggregation of the coloring material and the resin particles due to the aggregating agent varies depending on the type of the aggregating agent, the coloring material, and the resin particle and is able to be adjusted. In addition, it is possible for the aggregating agent to aggregate the coloring material and the resin particles by reacting with the coloring material and the resin particles included in the ink composition. By such aggregation, for example, it is possible to increase the coloring of the coloring material, to improve the fixing property of the resin particles, and/or to increase the viscosity of the ink composition.

The aggregating agent is not particularly limited and examples thereof include a metal salt, an inorganic acid, an organic acid, a cationic compound, and the like, and as the cationic compound, it is possible to use a cationic resin (cationic polymer), a cationic surfactant, and the like. Among these, a polyvalent metal salt is preferable as the metal salt, and a cationic resin is preferable as the cationic compound. Therefore, as the aggregating agent, it is preferable to use any one type of a cationic resin, an organic acid, and a polyvalent metal salt from the viewpoint of obtaining particularly excellent image quality, abrasion resistance, gloss, and the like.

The metal salt is preferably a polyvalent metal salt, but it is also possible to use metal salts other than polyvalent metal salts. Among these aggregating agents, it is preferable to use at least one type selected from a metal salt and an organic acid from the viewpoint of excellent reactivity with components included in the ink composition. In addition, among the cationic compounds, cationic resins are preferably used from the viewpoint of easy dissolution in the treatment liquid. In addition, it is also possible to use a plurality of aggregating agents in combination.

The polyvalent metal salt is a compound formed of divalent or higher valent metal ions and anions. Examples of the divalent or higher valent metal ion include ions such as calcium, magnesium, copper, nickel, zinc, barium, aluminum, titanium, strontium, chromium, cobalt, and iron. Among these metal ions forming the polyvalent metal salt, the metal ions are preferably at least one of calcium ions and magnesium ions from the viewpoint of an excellent aggregation property of components of the ink composition.

The anions forming the polyvalent metal salt are inorganic ions or organic ions. That is, the polyvalent metal salt in the invention is formed of inorganic ions or organic ions and polyvalent metals. Examples of such inorganic ions include chloride ions, bromide ions, iodine ions, nitrate ions, sulfate ions, hydroxide ions, and the like. Examples of organic ions include organic acid ions, for example, carboxylate ions.

The polyvalent metal compound is preferably an ionic polyvalent metal salt and, in particular, the stability of the treatment liquid is improved in a case where the polyvalent metal salt is a magnesium salt or a calcium salt. In addition, the counter ions of the polyvalent metal may be either inorganic acid ions or organic acid ions.

Specific examples of the polyvalent metal salt include calcium carbonates such as heavy calcium carbonate and light calcium carbonate, calcium nitrate, calcium chloride, calcium sulfate, magnesium sulfate, calcium hydroxide, magnesium chloride, magnesium carbonate, barium sulfate, chloride barium, zinc carbonate, zinc sulfide, aluminum silicate, calcium silicate, magnesium silicate, copper nitrate, calcium acetate, magnesium acetate, aluminum acetate, and the like. These polyvalent metal salts may be used alone or in a combination of two or more types. Among these, since it is possible to preserve sufficient solubility in water and reduce marks due to the treatment liquid (the traces are not noticeable), at least one of magnesium sulfate, calcium nitrate, and calcium chloride is preferable, and calcium nitrate is more preferable. These metal salts may have hydrated water in the form of a raw material.

Examples of metal salts other than polyvalent metal salts include monovalent metal salts such as sodium salt and potassium salt. Other examples include sodium sulfate, potassium sulfate, and the like.

Preferable examples of organic acids include poly(meth) acrylic acid, acetic acid, glycolic acid, malonic acid, malic acid, maleic acid, ascorbic acid, succinic acid, glutaric acid, fumaric acid, citric acid, tartaric acid, lactic acid, sulfonic acid, orthophosphoric acid, pyrrolidonecarboxylic acid, pyrone carboxylic acid, pyrrole carboxylic acid, furancarboxylic acid, pyridine carboxylic acid, coumaric acid, thiophene carboxylic acid, nicotinic acid, derivatives of these compounds, salts thereof, and the like. One type of organic acid may be used alone or a combination of two or more types may be used. Metal salts which are salts of organic acids are included in the metal salts described above.

Preferable examples of inorganic acids include sulfuric acid, hydrochloric acid, nitric acid, phosphoric acid, salts thereof, and the like. One type of inorganic acid may be used alone or a combination of two or more types may be used.

Examples of cationic resins (cationic polymers) include cationic urethane-based resin, cationic olefin-based resin, cationic amine-based resin, and the like.

As the cationic urethane-based resin, it is possible to appropriately select and use known resins. As the cationic urethane-based resin, it is possible to use commercially available products, and, for example, it is possible to use Hydran CP-7010, CP-7020, CP-7030, CP-7040, CP-7050, CP-7060, and CP-7610, (product names, manufactured by DIC Corp.), Superflex 600, 610, 620, 630, 640, and 650 (product names, manufactured by DKS Co., Ltd.), urethane emulsions WBR-2120C and WBR-2122C (product names, manufactured by Taisei Fine Chemical Co., Ltd.) and the like.

The cationic olefin resin has an olefin such as ethylene, propylene or the like in the structural skeleton thereof, and it is possible to appropriately select and use known resins. In addition, the cationic olefin resin may be in an emulsion state in which the cationic olefin resin is dispersed in a solvent including water, an organic solvent, or the like. As the cationic olefin resin, it is possible to use commercially available products and examples thereof include Arrowbase CB-1200 and CD-1200 (product names, manufactured by Unitika Ltd.), and the like.

As the cationic amine-based resin (cationic polymer), any cationic amine-based resin having an amino group in the structure may be used and it is possible to appropriately select and use known resins. Examples thereof include polyamine resin, polyamide resin, polyallylamine resin, and the like. The polyamine resin is a resin having an amino group in the main skeleton of the resin. The polyamide resin is a resin having an amide group in the main skeleton of the resin. The polyallylamine resin is a resin having a structure derived from an allyl group in the main skeleton of the resin.

The polyallylamine resin is, for example, polyallylamine hydrochloride, polyallylamine amide sulfate, allylamine hydrochloride diallylamine hydrochloride copolymer, allylamine acetate diallylamine acetate copolymer, allylamine hydrochloride dimethyl allylamine hydrochloride copolymer, allylamine dimethylallylamine copolymer, polydiallylamine hydrochloride, polymethyldiallylamine hydrochloride, polymethyldiallylamine amide sulfate, polymethyldiallylamine acetate, polydiallyldimethylammonium chloride, diallylamine acetate sulfur dioxide copolymer, diallyl methyl ethyl ammonium ethyl sulfate sulfur dioxide copolymer, methyl diallylamine hydrochloride sulfur dioxide copolymer, diallyldimethylammonium chloride sulfur dioxide copolymer, diallyldimethylammonium chloride acrylamide copolymer, and the like. As such a cationic allylamine-based resin, it is possible to use commercially available products and it is possible to use PAA-HCL-01, PAA-HCL-03, PAA-HCL-05, PAA-HCL-3L, PAA-HCL-10L, PAA-H-HCL, PAA-SA, PAA-01, PAA-03, PAA-05, PAA-08, PAA-15, PAA-15C, PAA-25, PAA-H-10C, PAA-D 11-HCL, PAA-D41-HCL, PAA-D19-HCL, PAS-21CL, PAS-M-1L, PAS-M-1, PAS-22SA, PAS-M-1A, PAS-H-1L, PAS-H-5L, PAS-H-10L, PAS-92, PAS-92A, PAS-J-81L, and PAS-J-81 (product names, manufactured by Nittobo Medical Co., Ltd.), Hymo Neo-600, Hymoloc Q-101, Q-311, Q-501, Himax SC-505, and SC-505 (product names, manufactured by Hymo Co., Ltd.), and the like.

Examples of cationic polyamine-based resins include Unisense KHE 103L manufactured by Senka Corp. (hexamethylene diamine/epichlorohydrin resin, 1% water-based solution with a pH of approximately 5.0, viscosity of 20 to 50 (mPa·s), and a water-based solution with a solid content concentration of 50% by mass), Unisense KHE104L (dimethylamine/epichlorohydrin resin, 1% water-based solution with a pH of approximately 7.0, a viscosity of 1 to 10 (mPa·s), and a water-based solution with a solid content concentration of 20% by mass), and the like.

Examples of the cationic surfactants include primary, secondary, and tertiary amine salt type compounds, alkylamine salts, dialkylamine salts, aliphatic amine salts, benzalkonium salts, quaternary ammonium salts, quaternary alkyl ammonium salts, alkyl pyridinium salts, sulfonium salts, phosphonium salts, onium salt, imidazolinium salts, and the like. Specific examples thereof include hydrochlorides and acetates such as laurylamine, Palm amine, and rosinamine, and the like, lauryl trimethyl ammonium chloride, cetyl trimethyl ammonium chloride, benzyl tributyl ammonium chloride, benzalkonium chloride, dimethyl ethyl lauryl ammonium ethyl sulfate, dimethyl ethyl octyl ammonium ethyl sulfate, trimethyl lauryl ammonium hydrochloride, cetyl pyridinium chloride, cetyl pyridinium bromide, dihydroxyethyl laurylamine, decyl dimethyl benzyl ammonium chloride, dodecyl dimethyl benzyl ammonium chloride, tetradecyl dimethyl ammonium chloride, hexadecyl dimethyl ammonium chloride, octadecyl dimethyl ammonium chloride, and the like.

A plurality of types of these aggregating agents may be used. In addition, if at least one type of the polyvalent metal salt, organic acid, and cationic resin is selected from among these aggregating agents, the aggregating action is better, such that it is possible to form an image of higher image quality (in particular, a good coloring property).

The total content of the aggregating agent in the treatment liquid is, for example, 0.1% by mass or more and 20% by mass or less with respect to the total mass of the treatment liquid, preferably 0.5% by mass or more and 15% by mass or less, and more preferably 2% by mass or more and 10% by mass or less. Even in a case where the aggregating agent is common to both the solution and the dispersion, the solid content is preferably in the above range. When the content of the aggregating agent is 0.1% by mass or more, it is possible to obtain a sufficient performance in terms of the aggregating agent aggregating the components included in the ink composition. In addition, setting the content of the aggregating agent is 30% by mass or less makes the solubility and dispersibility of the aggregating agent in the treatment liquid better, and makes it possible to improve storage stability and the like of the treatment liquid.

Even in a case where the organic solvent included in the treatment liquid has high hydrophobicity, from the point of view of good solubility of the aggregating agent in the treatment liquid, it is preferable to use an aggregating agent in which the solubility in 100 g of water at 25° C. is 1 g or more, and more preferable to use an aggregating agent in which the solubility is 3 g or more and 80 g or less.

1.4.1.2. Other Components

For the treatment liquid, it is possible to set the content of components which may be included in the above-described ink composition, the content, characteristics, and the like thereof to be similar to those of the above ink composition. The treatment liquid is preferably not used for coloring the recording medium and, in such a case, the content of the coloring material in the treatment liquid is preferably 0.2% by mass or less, more preferably 0.1% mass or less, and even more preferably 0.05% by mass or less, and the lower limit of the content is 0% by mass or more.

Water-Soluble Organic Solvent

The treatment liquid may include the amide compound represented by the above General Formula (1) and a water-soluble organic solvent. Since the details of these types and contents are the same as those of the ink composition, explanation thereof is omitted.

Surfactant

The treatment liquid may contain a surfactant. The surfactant is provided with a function of lowering the surface tension of the treatment liquid and improving the wettability with the recording medium. Among surfactants, for example, it is possible to preferably use acetylene glycol-based surfactants, silicone-based surfactants, and fluorine-based surfactants. Since the details of the type and content of the surfactant are the same as those of the ink composition, explanation thereof is omitted.

Water

The treatment liquid used in the ink jet recording method according to the present embodiment may contain water. The treatment liquid is preferably a water-based treatment liquid.

Curing Agent

In a case such as where a urethane resin is included in the ink composition as a curing agent, the treatment liquid may include a curing agent which reacts with the hydroxyl group of the urethane resin. Reacting the curing agent in the treatment liquid with the urethane resin in the ink composition makes it possible to form a cross-linked structure and to further improve the abrasion resistance of the coating film.

Examples of the curing agent include isocyanates, such as aromatic diisocyanates such as phenylene diisocyanate, tolylene diisocyanate, diphenylmethane diisocyanate, and naphthalene diisocyanate; aliphatic or alicyclic diisocyanates such as hexamethylene diisocyanate, lysine diisocyanate, cyclohexane diisocyanate, isophorone diisocyanate, dicyclohexyl methane diisocyanate, xylylene diisocyanate, tetramethylxylylene diisocyanate, and 2,2,4-trimethylhexamethylene diisocyanate, and the like. These may be used alone, or a combination of two or more types thereof may be used. In a case of employing a curing agent, the curing agent is preferably set to approximately 0.5 to 10.0% by mass of the total treatment liquid.

Additive

As additives, the treatment liquid may contain ureas, amines, saccharides, and the like.

Others

The treatment liquid used in the ink jet recording method according to the present embodiment may further contain components such as an anti-septic/mildewproofing agent, a rust preventive agent, a chelating agent, a wax, a viscosity modifier, an anti-oxidant, and a preservative, as necessary.

1.4.2. Physical Properties of Treatment Liquid and Method of Attachment to Recording Medium From the viewpoint of making the wetting and spreading property to the recording medium appropriate, the surface tension of the treatment liquid according to the present embodiment at 25° C. is 40 mN/m or less, preferably 38 mN/m or less, more preferably 35 mN/m or less, and even more preferably 30 mN/m or less. It is possible to measure the surface tension by confirming the surface tension when a platinum plate is wetted with the composition in an environment of 25° C. using an automatic surface tensiometer CBVP-Z (manufactured by Kyowa Interface Science, Inc.).

Examples of methods for attaching the treatment liquid to the recording medium include non-contact type and contact type methods or combinations thereof, such as a method of ejecting/coating fine liquid droplets by an ink jet method, a method of coating a treatment liquid on a recording medium using various types of spray, a method of coating by immersing a recording medium in treatment liquid, a method of coating treatment liquid on a recording medium with a brush or the like.

In a case where the treatment liquid is attached to the recording medium by a method other than the ink jet method, the viscosity at 20° C. may be higher than that in the case of the ink jet method, for example, 1.5 mPa·s or more and 100 mPa·s or less, preferably 1.5 mPa·s or more and 50 mPa·s or less, and more preferably 1.5 mPa·s or more and 20 mPa·s or less. It is possible to measure the viscosity by raising the Shear Rate from 10 to 1000 in an environment of 20° C. using a viscoelasticity tester MCR-300 (manufactured by Pysica) and reading the viscosity at Shear Rate 200.

In addition, the treatment liquid may be attached to a recording medium by an ink jet method, and in such a case, the viscosity at 20° C. is preferably 1.5 mPa·s or more and 15 mPa·s or less, more preferably 1.5 mPa·s or more and 5 mPa·s or less, and even more preferably 1.5 mPa·s or more and 3.6 mPa·s or less.

In a case where this step is included, the recording region of the recording medium to which the treatment liquid and the ink composition are to be attached preferably has a region in which the attachment amount of the treatment liquid is 5.0% by mass or more and 20.0% by mass or less with respect to the attachment amount of the ink composition, and more preferably as a region in which the attachment amount of the treatment liquid is 10.0% by mass or more and 15.0% by mass or less. Such a case is preferable from the viewpoint of superior bleeding resistance and abrasion resistance. Furthermore, in a recording region of the recording medium in which the treatment liquid and the ink composition are to be attached, it is preferable for the attachment amount of the treatment liquid in the region where the attachment amount of the treatment liquid is the maximum with respect to the attachment amount of the ink composition to be in the range described above in view of the above points.

The ink composition may be further attached to the recording region of the recording medium to which the treatment liquid and the ink composition are to be attached and, in such a case, it is preferable to have a region in which the attachment amount of the ink composition is the same as the attachment amount of the ink composition described above, in view of the above points.

In a case of using a treatment liquid, the durability tended to particularly deteriorate in a case where the remaining amount of the solvent was large, but this is presumed to be because of the influence of the aggregating agent remaining in the recorded matter and because the components of the ink composition on the recorded matter do not easily form a film. However, according to the ink jet recording method of the present embodiment, in the drying step, it is possible to sufficiently dry the organic solvent and form a film.

1.4.3. Step of Attaching Clear Ink Composition to Recording Medium

The ink jet recording method of the present embodiment may include a step of attaching a clear ink composition to a recording medium. That is, an ink composition including the amide compound represented by General Formula (1) used in the present embodiment may be used as a clear ink composition. In addition, or alternatively, a colored ink composition and a clear ink composition are used and any of the ink compositions may be a water-based ink composition including an amide compound represented by General Formula (1) used in the present embodiment.

The clear ink composition is not an ink used for coloring a recording medium, but an ink used for other purposes. Other purposes include improving the characteristics such as the abrasion resistance of the recorded matter, adjusting the glossiness of the recorded matter, fixing property of the ink, and the like, without being limited thereto. The content of the coloring material of the clear ink composition is preferably 0.2% by mass or less, more preferably 0.1% by mass or less, and even more preferably 0.05% by mass or less, and the lower limit of the content may be 0% by mass. The clear ink composition is not the above treatment liquid. The clear ink composition does not include, for example, an aggregating agent as described above.

It is possible for the clear ink composition to be the same in relation to the content of the components which may be included in the above ink composition, the content, the characteristics, and the like. It is possible for the clear ink composition to be a water-based ink composition including the resin described above, and the amide compound represented by General Formula (1) as an organic solvent. In addition, the colored ink composition is a water-based ink composition including the above resin and an amide compound represented by General Formula (1) as an organic solvent, in which, as long as the clear ink composition includes a resin and an organic solvent, the amide compound represented by General Formula (1) may not be included as an organic solvent.

In addition, from the viewpoint of the drying property of the image, the content of the amide compound represented by General Formula (1) in the clear ink composition is preferably 1% by mass or less. In addition, the content of the amide compound represented by General Formula (1) in the clear ink composition is preferably smaller than the content of the amide compound represented by General Formula (1) included in the colored ink composition, and the content difference is more preferably 5% by mass or more.

The clear ink composition is attached by an ink jet method to the recording region formed by the step of attaching an ink composition to the recording medium, and it is possible to form an overcoat layer. Performing this step makes it possible to further improve the abrasion resistance of the obtained image.

In the case of performing this step, the above drying step is performed afterward, and the organic solvent in the recording region is dried to 2.0 mg/inch$^2$ or less. This makes it possible to make the image excellent in abrasion resistance and lamination resistance.

From the viewpoint of making the wetting and spreading property on the recording medium appropriate, the surface tension of the clear ink composition at 25° C. is 40 mN/m or less, preferably 38 mN/m or less, more preferably 35 mN/m or less, and even more preferably 30 mN/m or less. In the clear ink composition, the viscosity at 20° C. is preferably 1.5 mPa·s or more and 15 mPa·s or less, more preferably 1.5 mPa·s or more and 5 mPa·s or less, and even more preferably 1.5 mPa·s or more and 3.6 mPa·s or less.

Recorded Matter

It is possible to use the recorded matter obtained by the recording method of the present embodiment for display or the like as it is. In addition, since it is possible to obtain recorded matter excellent in lamination resistance using the recording method of the present embodiment, recorded matter able to be used after being laminated is preferable. For example, the invention is preferably used for preparing a laminate film. It is possible to perform the step of laminating the recorded matter (lamination step) by laminating protective films on the recording surface of the recorded matter by sticking a film or the like thereto. In addition, although not particularly limited, a known adhesive may be attached to the recording surface of the recorded matter and the film may be stuck thereto, or a film to which an adhesive is attached may be stuck to the recording surface of the recorded matter. Alternatively, preparation is also possible by extruding a molten resin onto the recording surface of recorded matter using a molten resin in which the film is melted and forming the result as a film on the recording surface of the recorded matter. As a material such as a film used for lamination, for example, it is possible to use a film formed of resin. Laminating the recorded matter is preferable in terms of light resistance of the recorded matter being excellent and the protection being excellent in a case of excessive handling such as a solid object hitting the recorded matter. In addition, after the recorded matter and the film are stuck to each other, it is preferable to sufficiently carry out the adhesion by further carrying out heating or pressing at room temperature.

1.5. Operation and Effect

The ink jet recording method of the present embodiment is provided with an ink attaching step and a drying step, in which the ink composition is a water-based ink composition including a resin and an amide compound represented by General Formula (1) as an organic solvent, and the drying step dries the organic solvent in the recording region of the recording medium to be 2.0 mg/inch$^2$ or less. Therefore, it is possible to form an image with high lamination resistance while maintaining the high abrasion resistance of the recorded image.

2. EXAMPLES AND COMPARATIVE EXAMPLES

A more detailed description will be given of embodiments of the invention with reference to Examples, but the present embodiment is not limited to these Examples.

2.1. Preparation of Treatment Liquid and Ink Composition

Each component was placed in a container so as to have the compositions shown in Table 1, mixed and stirred with a magnetic stirrer for 2 hours, and then filtered with a membrane filter having a pore size of 5 μm to obtain treatment liquids (R1 to R4), cyan inks (C1 to C7), and clear inks (CL1 to CL2). The numerical values in Table 1 indicate mass %.

TABLE 1

| | | Treatment Liquid | | | | Color Ink | | |
|---|---|---|---|---|---|---|---|---|
| | | R1 | R2 | R3 | R4 | C1 | C2 | C3 |
| Coloring material | Pigment dispersion: C.I. Pigment Blue 15:3 20% by mass Resin dispersant 4% by mass | — | — | — | — | 20.83 (5) | 20.83 (5) | 20.83 (5) |
| Reactive component | Polyvalent metal salt: magnesium sulfate heptahydrate | 7 | — | — | 7 | — | — | — |
| | Polyallylamine resin free type (cationic resin, 20% by mass water-based solution) | — | 35 (7) | — | — | — | — | — |
| | Organic acid: malonic acid | — | — | 7 | — | — | — | — |
| | Water-dispersible polyisocyanate (pure component 25% by mass liquid) | — | — | — | 40 (10) | — | — | — |
| Resin particles | Urethane resin emulsion Tg: 25%° C. <30% dispersion> | — | — | — | — | 16.67 (5) | 16.67 (5) | — |
| | Styrene-acrylate copolymer emulsion (acrylic-based resin) Tg: 75%° C. <47% dispersion> | — | — | — | — | — | — | 10.64 (5) |
| Wax | Polyethylene wax emulsion (polyolefin-based) Melting point: 103%° C. <40% dispersion> | — | — | — | — | 2.5 (1) | 2.5 (1) | 2.5 (1) |
| Solvent of Formula (1) | 3-methoxy-N,N-dimethylpropaneamide Standard boiling point 215° C. | 10 | 10 | 10 | 10 | 15 | — | 15 |
| | 3-butoxy-N,N-dimethylpropaneamide Standard boiling point 252° C. | — | — | — | — | — | 15 | — |
| Other solvents | Propylene glycol standard boiling point 189° C. | 15 | 15 | 15 | 25 | 6 | 6 | 6 |
| | 1,3-butylene glycol standard boiling point 208° C. | 5 | 5 | 5 | 5 | 6 | 6 | 6 |
| | 1,2-hexanediol standard boiling point 224° C. | 5 | 5 | 5 | 5 | 3 | 3 | 3 |
| | 2-pyrrolidone standard boiling point 245° C. | — | — | — | — | 5 | 5 | 5 |
| | Glycerine standard boiling point 290° C. | — | — | — | — | — | — | — |
| Additives | BYK-348 (Silicone-based surfactant) | 0.5 | 0.5 | 0.5 | 0.5 | 0.5 | 0.5 | 0.5 |
| | Triisopropanolamine (pH adjusting agent) standard boiling point 305° C. | 0.1 | 0.1 | 0.1 | 0.1 | 3 | 3 | 3 |
| Water | Ion exchanged water | Remainder | Remainder | Remainder | Remainder | Remainder | Remainder | Remainder |
| Total | | 100 | 100 | 100 | 100 | 100 | 100 | 100 |

| | | Color Ink | | | | Clear Ink | |
|---|---|---|---|---|---|---|---|
| | | C4 | C5 | C6 | C7 | CL1 | CL2 |
| Coloring material | Pigment dispersion: C.I. Pigment Blue 15:3 20% by mass Resin dispersant 4% by mass | 20.83 (5) | 20.83 (5) | 20.83 (5) | 20.83 (5) | — | — |
| Reactive component | Polyvalent metal salt: magnesium sulfate heptahydrate | — | — | — | — | — | — |
| | Polyallylamine resin free type (cationic resin, 20% by mass water-based solution) | — | — | — | — | — | — |
| | Organic acid: malonic acid | — | — | — | — | — | — |
| | Water-dispersible polyisocyanate (pure component 25% by mass liquid) | — | — | — | — | — | — |
| Resin particles | Urethane resin emulsion Tg: 25%° C. <30% dispersion> | 16.67 (5) | 16.67 (5) | 16.67 (5) | 16.67 (5) | 20 (6) | 20 (6) |
| | Styrene-acrylate copolymer emulsion (acrylic-based resin) Tg: 75%° C. <47% dispersion> | — | — | — | — | — | — |
| Wax | Polyethylene wax emulsion (polyolefin-based) Melting point: 103%° C. <40% dispersion> | 2.5 (1) | 2.5 (1) | 2.5 (1) | 2.5 (1) | 5 (2) | 5 (2) |

TABLE 1-continued

| | | | | | | | |
|---|---|---|---|---|---|---|---|
| Solvent of Formula (1) | 3-methoxy-N,N-dimethylpropaneamide Standard boiling point 215° C. | 5 | 15 | — | — | 15 | 1 |
| | 3-butoxy-N,N-dimethylpropaneamide Standard boiling point 252° C. | — | — | — | — | — | — |
| Other solvents | Propylene glycol standard boiling point 189° C. | 6 | 1 | 6 | 6 | 6 | 6 |
| | 1,3-butylene glycol standard boiling point 208° C. | 6 | 6 | 6 | 6 | 6 | 6 |
| | 1,2-hexanediol standard boiling point 224° C. | 3 | 3 | 3 | 3 | 3 | 3 |
| | 2-pyrrolidone standard boiling point 245° C. | 5 | 5 | 20 | 5 | — | — |
| | Glycerine standard boiling point 290° C. | — | 5 | — | — | — | — |
| Additives | BYK-348 (Silicone-based surfactant) | 0.5 | 0.5 | 0.5 | 0.5 | 0.5 | 0.5 |
| | Triisopropanolamine (pH adjusting agent) standard boiling point 305° C. | 3 | 3 | 3 | 3 | 3 | 3 |
| Water | Ion exchanged water | Remainder | Remainder | Remainder | Remainder | Remainder | Remainder |
| Total | | 100 | 100 | 100 | 100 | 100 | 100 |

* Numerical values in parentheses represent solid content.

In Table 1, the materials other than those described by the compound name are as follows.

Pigment dispersion: 20% by mass solution of C.I. Pigment Blue 15:3; the resin dispersant is a styrene-acrylic-based water-soluble resin and is contained as 4% by mass.

Cationic polymer: polyallylamine resin free type (cationic resin, 20% by mass water-based solution) (product name: PAA-05, manufactured by Nittobo Medical Co., Ltd.)

Water-dispersible polyisocyanate: Elastron E-37 manufactured by DKS Co., Ltd.

Urethane resin emulsion: Takelac W-6061, manufactured by Mitsui Chemical Co., Ltd.

Styrene-acrylic acid copolymer emulsion: JONCRYL 2350 manufactured by BASF Japan Ltd.

Polyethylene wax emulsion: Nopcoat PEM-17 (product name, manufactured by San Nopco Limited, polyethylene wax emulsion, melting point 103° C., 40% dispersion)

BYK-348 (product name, manufactured by BYK Japan, silicone-based surfactant)

2.2. Preparing Recorded Matter

The recorded matter used for each evaluation was created as follows. A modified machine of an ink jet printer SC-S 40650 (product name, manufactured by Seiko Epson Corporation) was prepared. Three recording heads were arranged in order from the upstream side to the downstream side in the transport direction of the recording medium (product name: Scotchcal Graphic Film IJ 180-10: polyvinyl chloride film manufactured by 3M Company). The treatment liquid, the colored ink composition, and the clear ink composition were filled in order from the head on the upstream side. In the recording medium, each treatment liquid and composition were overlaid on a test pattern and recorded in this order. For each treatment liquid and composition, the dot density and the like were adjusted and recording was performed so as to have the coating amounts (attachment amounts) in the Table and the maximum resolution of 1440×1400 dpi as the basic resolution. The test pattern was 30×30 cm in size.

In addition, a platen heater was provided for a common platen which faces the three recording heads. Air was blown toward the recording medium with a fan from above the head. The air speed and air temperature are set as shown in the Table. The platen heater was adjusted such that the surface temperature of the recording medium during the attaching step was as in the Table.

Secondary drying was performed with a secondary drying furnace (infrared irradiation) downstream from the recording head. In the secondary drying furnace, a heat transfer heater for heating the recording medium from the bottom with a heater provided in the recording medium support portion, an IR irradiator for heating from above the recording medium, and a blowing means are provided such that it is possible for each to adjust the heating temperature. In the secondary drying furnace, the length of the transport path therefor was also adjustable. Thus, the heating temperature and time of the recorded portion of the recording medium were adjusted for each example such that the organic solvent remaining amounts in the Table were obtained. In this manner, the time was also controlled in addition to the temperature adjustment. The surface temperatures of the recording media in the secondary drying (post-drying) were the values in the Table. The temperature of the IR irradiation is the temperature when measuring the surface temperature of the recording medium only with IR irradiation without the influence of heat transfer or air blowing. The air temperature is also the same. The surface temperature of the recording medium is the maximum temperature in this step.

Then, recorded matter was obtained using the treatment liquid, colored ink composition, and clear ink composition described in Table 1 as described in Table 2. In Table 2, "-" in the column of ink composition indicates that the ink composition is not attached. The remaining amount of the organic solvent in the recorded matter was measured by the method described above.

TABLE 2

| | | Example | | | | | | | | | | | | |
|---|---|---|---|---|---|---|---|---|---|---|---|---|---|---|
| | | 1 | 2 | 3 | 4 | 5 | 6 | 7 | 8 | 9 | 10 | 11 | 12 | 13 |
| Treatment liquid type | | R1 | R1 | R1 | R1 | R1 | R1 | R1 | R1 | R2 | R3 | R4 | R1 | R1 |
| Colored ink type | | C1 | C2 | C3 | C4 | C5 | C1 | C1 | C1 | C1 | C1 | C1 | C1 | C1 |
| Clear ink type | | — | — | — | — | — | — | — | — | — | — | — | CL1 | CL2 |
| Treatment liquid attachment amount (mg/inch$^2$) | | 2 | 2 | 2 | 2 | 2 | 2 | 2 | 2 | 2 | 2 | 2 | 2 | 2 |
| Colored ink attachment amount (mg/inch$^2$) | | 20 | 20 | 20 | 20 | 20 | 20 | 20 | 20 | 20 | 20 | 20 | 20 | 20 |
| Clear ink attachment amount (mg/inch$^2$) | | — | — | — | — | — | — | — | — | — | — | — | 4 | 4 |
| Attaching step | Air speed (m/sec) | 2 | 2 | 2 | 2 | 2 | 2 | 2 | 2 | 2 | 2 | 2 | 2 | 2 |
| | Air temperature (° C.) | 25 | 25 | 25 | 25 | 25 | 25 | 25 | 25 | 25 | 25 | 25 | 25 | 25 |
| | Heated recording medium temperature (° C.) | 35 | 35 | 35 | 35 | 35 | 35 | 35 | 35 | 35 | 35 | 35 | 35 | 35 |
| Post-drying step | Air speed (m/sec) | 5 | 5 | 5 | 5 | 5 | 5 | 5 | — | 5 | 5 | 5 | 5 | 5 |
| | Air temperature (° C.) | 50 | 50 | 50 | 50 | 50 | 50 | 50 | — | 50 | 50 | 50 | 50 | 50 |
| | Infrared radiation: recording medium temperature (° C.) | — | — | — | — | — | — | 75 | — | — | — | — | — | — |
| | Heated recording medium temperature (° C.) | 95 | 95 | 95 | 95 | 100 | 80 | 90 | 100 | 95 | 95 | 95 | 95 | 95 |
| Solvent remaining amount (mg/inch$^2$) | | 1.0 | 1.3 | 1.0 | 0.6 | 1.9 | 1.8 | 0.4 | 1.7 | 1.0 | 1.0 | 1.0 | 1.0 | 0.7 |
| Evaluation results | | | | | | | | | | | | | | |
| Durability | Lamination resistance | B | B | A | A | C | C | A | C | B | B | B | B | A |
| | Blocking resistance | B | C | A | B | C | B | A | B | A | B | A | B | A |
| | Abrasion resistance | B | B | A | C | C | C | A | C | A | A | A | A | A |
| | Fixing property (tape peeling) | B | B | C | C | C | C | A | C | A | B | A | A | A |
| Image quality | | A | A | A | A | A | A | A | A | B | B | A | A | A |
| Clogging resistance (colored ink) | | B | A | A | A | A | B | B | B | B | B | B | B | B |

| | | Example | | | | Comparative Example | | | | |
|---|---|---|---|---|---|---|---|---|---|---|
| | | 14 | 15 | 16 | 17 | 1 | 2 | 3 | 4 | 5 |
| Treatment liquid type | | R1 | R1 | — | R1 | R1 | R1 | R1 | — | R1 |
| Colored ink type | | C1 | C1 | C1 | C1 | C6 | C7 | C1 | C1 | C7 |
| Clear ink type | | — | — | — | — | — | — | — | — | — |
| Treatment liquid attachment amount (mg/inch$^2$) | | 1 | 2 | — | 4 | 2 | 2 | 2 | — | 2 |
| Colored ink attachment amount (mg/inch$^2$) | | 10 | 20 | 20 | 20 | 20 | 20 | 20 | 20 | 20 |
| Clear ink attachment amount (mg/inch$^2$) | | — | — | — | — | — | — | — | — | — |
| Attaching step | Air speed (m/sec) | 2 | 2 | 2 | 2 | 2 | 2 | 2 | 2 | 2 |
| | Air temperature (° C.) | 25 | 25 | 25 | 25 | 25 | 25 | 25 | 25 | 25 |
| | Heated recording medium temperature (° C.) | 35 | 35 | 35 | 35 | 35 | 35 | 35 | 35 | 35 |
| Post-drying step | Air speed (m/sec) | 5 | 5 | 5 | 5 | 5 | 5 | 5 | 5 | 5 |
| | Air temperature (° C.) | 50 | 50 | 50 | 50 | 50 | 50 | 50 | 50 | 50 |
| | Infrared radiation: recording medium temperature (° C.) | — | — | — | — | — | — | — | — | — |
| | Heated recording medium temperature (° C.) | 90 | 95 | 95 | 95 | 95 | 95 | 75 | 90 | 80 |
| Solvent remaining amount (mg/inch$^2$) | | 0.5 | 1.0 | 1.5 | 1.0 | 1.0 | 1.0 | 2.3 | 3.2 | 2.0 |
| Evaluation results | | | | | | | | | | |
| Durability | Lamination resistance | A | B | B | B | A | A | D | D | B |
| | Blocking resistance | A | B | A | C | B | B | D | D | B |
| | Abrasion resistance | B | B | A | C | D | D | C | A | D |
| | Fixing property (tape peeling) | B | B | A | C | C | D | C | A | D |
| Image quality | | A | B | C | A | A | A | A | C | A |
| Clogging resistance (colored ink) | | B | A | B | B | A | A | B | B | A |

2.3. Evaluation Method 2.3.1. Lamination Resistance

With respect to the recorded matter obtained in each example, GIL-1148 (product name, manufactured by Lintec Corporation) which is a laminate film was laminated on the recording surface. The laminated recorded matter was allowed to stand at 40° C.xhumidity 80% RH for 5 days, after which the durability (lamination resistance) was evaluated according to the following evaluation criteria. The evaluation results are shown in Table 2.

A: No peeling of laminate or generation of bubbles.

B: There is slight bubble generation.

C: The generation of bubbles was noticeable.

D: The generation of air bubbles was noticeable and peeling of the laminate generated.

2.3.2. Blocking Resistance

With respect to the recorded matter obtained in each example, the rear surface of the recording medium was overlapped on the printed surface of the recorded matter and a load of 500 g/cm$^2$ was applied thereto and the result was left to stand for 24 hours in an environment of 20 to 25° C./40 to 60% RH. After being left to stand, the peeling of the image of the recorded matter and the state of transfer to the rear surface were visually observed and the durability (blocking resistance) was evaluated according to the following evaluation criteria. The obtained results are shown in Table 2.

A: Peeling is not recognized in the image of the recording pattern, and no transfer of the image is visible even when the recorded matter is overlapped.

B: Although peeling is not visible in the image of the recording pattern, transfer of the image is slightly visible in a case where the recorded matter is overlapped.

C: Peeling is visible in the image of the recording pattern, and transfer of the image is visible in a case where the recorded matter is overlapped.

D: The image of the recording pattern is largely peeled off, and transfer of the image is visible in a case where the recorded matter is overlapped.

2.3.3. Abrasion Resistance

The recording region of the recorded matter obtained in each example was cut into a rectangle of 30×150 mm. Then, rubbing was carried out on a color fastness rubbing tester AB-301 (product name, manufactured by Tester Sangyo Co., Ltd.) for ten reciprocations under a load of 500 g with a friction block to which a plain weave fabric was attached. Then, peeling of the recorded matter on the recording medium was visually observed, and the abrasion resistance was evaluated according to the following evaluation criteria. The obtained results are shown in Table 2.

A: No peeling occurred and there was no transfer to the cloth.

B: No peeling occurred, but there was transfer to the cloth.

C: Peeling occurred in less than 10% of the evaluation area.

D: Peeling occurred in 10% or more of the evaluation area.

2.3.4. Adhesion (Tape Peeling)

A cross cut test was performed in the recording region of the recorded matter obtained in each example. 100 cross cuts of 1×1 mm were prepared in the recording region with a cutter, and cellophane tape was stuck thereto and stripped 50 times. Adhesion was evaluated according to the following evaluation criteria. The obtained results are shown in Table 2.

A: No peeling

B: Peeling is less than 3 parts

C: Peeling is 4 to 10 parts

D: Peeling is 11 parts or more 2.3.5. Image Quality

The recorded matter obtained in each example was visually evaluated. The image quality was evaluated according to the following evaluation criteria. The obtained results are shown in Table 2.

A: No shading unevenness is seen in the recording pattern.

B: Some shading unevenness is seen in the recording pattern.

C: Shading unevenness is noticeable in the recording pattern.

2.3.6. Clogging Resistance (Colored Ink)

With regard to the ejection of colored ink in each example, clogging resistance was evaluated according to the following evaluation criteria. The obtained results are shown in Table 2. In this evaluation, a case where image recording was continuously performed for one hour and a case where image recording was performed for three hours continuously were evaluated.

A: No defective nozzles.

B: No defective nozzles in 1 hour. Defective nozzles occurred in 3 hours.

C: A defective nozzle occurred in 1 hour.

2.4. Evaluation Results

From the above examples, the following was found.

It was possible to have both excellent abrasion resistance and lamination resistance in all the Examples including an ink attaching step of ejecting an ink composition from a head to attach to a recording region of a recording medium, and a drying step of heating the recording medium to which the ink composition is attached, in which the ink composition is a water-based ink composition including a resin and an amide compound represented by General Formula (1) as an organic solvent, and the drying step dries the organic solvent in the recording region of the recording medium to be 2.0 mg/inch$^2$ or less. On the other hand, in all of the Comparative Examples which were not as above, either of the abrasion resistance and lamination resistance was inferior.

From the comparison between Examples 1 and 6, the lamination resistance and the like were superior as the remaining amount of the organic solvent was lower.

From the comparison of Examples 1 and 4, having a higher solvent content of the ink represented by General Formula (1) was superior in abrasion resistance and the like. From this, it was found that the invention is useful in that it is possible to obtain excellent lamination resistance in a case where the ink includes the solvent represented by General Formula (1) and excellent abrasion resistance is obtained.

From the comparison between Examples 1 and 3, when the ink includes an acrylic-based resin, the lamination resistance and the like were superior. On the other hand, it was found that the invention is useful in that it is possible to obtain excellent lamination resistance even in a case where the ink includes a urethane resin.

In Example 5, a higher heating temperature was necessary in the heating step to lower the remaining amount of organic solvent. In addition, a longer heating time was necessary. It was found that the content of the high-boiling point solvent in the ink is preferably smaller. Although not as much as for the ink used in Example 5, even for other inks, for example, the ink used in Example 1, it is necessary to excessively raise the heating temperature in the post-drying step or excessively lengthen the heating time in a case of further lowering the remaining amount of the organic solvent, and the remaining amount of the organic solvent was preferably set to approximately 0.1 mg/inch$^2$ or more.

From the comparison between Examples 7, 8, and 1, using a blower type or a radiation type in the heating step allows drying to be efficiently performed and it is preferable in that drying is possible without excessively increasing the heating temperature of the recording medium.

From the comparison of Examples 14, 16, 17, and 1, superior image quality was obtained using the treatment liquid; however, deterioration in the blocking resistance and the like was observed. From this, it was found that the invention is useful in that it is possible to obtain excellent blocking resistance in a case where a superior image quality is obtained using a treatment liquid. In a case where the treatment liquid was not used, there was a tendency for a longer time to be necessary for the heating step. In a case of using the treatment liquid, it is presumed that solid-liquid separation of the ink proceeds easily and drying of the liquid components of the ink is promoted.

From the comparison between Examples 12, 13, and 1, in a case where clear ink was used, the abrasion resistance and the like were superior. In addition, the lamination resistance was superior as the content of the solvent of General Formula (1) included in the clear ink was lower.

In Comparative Examples 1, 2, and 5, the ink did not include the amide compound represented by General Formula (1), and the lamination resistance was good, but the abrasion resistance was inferior.

In Comparative Examples 3 and 4, the remaining amount of solvent in the post-drying step exceeded 2.0 mg/inch$^2$, and the lamination resistance was poor.

The invention is not limited to the above-described embodiments, and various modifications thereto are possible. For example, the invention includes configurations substantially the same as the configuration described in the embodiment (for example, a configuration having the same function, a method and a result, or a configuration having the same object and effect). In addition, the invention includes a configuration in which non-essential parts of the configuration described in the embodiment are replaced. In addition, the invention includes a configuration which achieves the same operation and effect as the configuration described in the embodiment, or a configuration which is able to achieve the same object. In addition, the invention includes a configuration in which a known technique is added to the configuration described in the embodiment.

The entire disclosure of Japanese Patent Application No. 2018-056404, filed Mar. 23, 2018 is expressly incorporated by reference herein.

What is claimed is:

1. An ink jet recording method comprising: attaching ink to a recording region of a recording medium by ejecting an ink composition from a head; and heating the recording medium to which the ink composition is attached, wherein the ink composition is a water-based ink composition including a resin and an amide compound represented by General Formula (1) as an organic solvent:

(1)

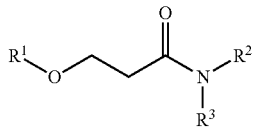

where $R^1$ represents a linear or branched alkyl group having 1 to 6 carbon atoms; $R^2$ and $R^3$ represent each independently H or a linear or branched alkyl group having 1 to 4 carbon atoms, an attachment amount of the ink composition to the recording region is 7.0 mg/inch$^2$ or more and 35.0 mg/inch$^2$ or less, and in the heating, the organic solvent in the recording region of the recording medium is dried to be 0.1 mg/inch$^2$ or more and 2.0 mg/inch$^2$ or less.

2. The ink jet recording method according to claim 1, wherein, in the heating, the organic solvent in the recording region of the recording medium is dried to be 0.1 mg/inch$^2$ or more and 1.0 mg/inch$^2$ or less.

3. The ink jet recording method according to claim 1, further comprising:

attaching a treatment liquid, which includes an aggregating agent for aggregating components of the ink composition, to the recording region of the recording medium.

4. The ink jet recording method according to claim 3, wherein the aggregating agent is one or more types of a cationic resin, an organic acid, and a polyvalent metal salt.

5. The ink jet recording method according to claim 3, wherein a recording region in which an attachment amount of the treatment liquid is 5.0% by mass or more and 20.0% by mass or less with respect to an attachment amount of the ink composition, is provided.

6. The ink jet recording method according to claim 1, wherein a content of an organic solvent of a polyol having a standard boiling point of more than 280° C. in the ink composition is 1.0% by mass or less with respect to a total mass of the ink composition.

7. The ink jet recording method according to claim 1, wherein the recording medium is a low-absorption recording medium or a non-absorption recording medium.

8. The ink jet recording method according to claim 1, wherein the ink composition includes a urethane resin.

9. The ink jet recording method according to claim 1, wherein recorded matter obtained by the recording method is used after being laminated.

10. The ink jet recording method according to claim 1, wherein the amide compound represented by General Formula (1) is included as 3.0% by mass or more and 40.0% by mass or less with respect to a total mass of the ink composition.

11. The ink jet recording method according to claim 1, wherein the heating is performed using one or more types of radiation, blowing, and heat transfer.

12. The ink jet recording method according to claim 1, wherein the ink composition includes, as an organic solvent, one or more types of polyols, alkanediols, and glycol ethers having a standard boiling point of 280° C. or lower.

13. The ink jet recording method according to claim 1, wherein a region in the recording region in which the attachment amount of the ink composition is 9.0 mg/inch$^2$ or more and 25.0 mg/inch$^2$ or less is provided.

14. The ink jet recording method according to claim 1, wherein a colored ink composition including a resin and an organic solvent and a clear ink composition including a resin and an organic solvent are used, and any one of the ink compositions is a water-based ink composition.

15. The ink jet recording method according to claim 14, wherein the content of the amide compound represented by General Formula (1) in the clear ink composition is 1% by mass or less.

16. An ink jet recording apparatus for performing recording by the ink jet recording method according to claim 1.

17. An ink jet recording apparatus for performing recording by the ink jet recording method according to claim 2.

18. An ink jet recording apparatus for performing recording by the ink jet recording method according to claim 3.

19. The ink jet recording method according to claim 1, wherein, in the heating, an amount of the organic solvent remaining in the recording region of the recording medium after the recording medium is dried is 0.5 mg/inch$^2$ or more and 2.0 mg/inch$^2$ or less.

20. The ink jet recording method according to claim 1, wherein, in the heating, the temperature of the recording medium is 90 degrees C. or greater.

* * * * *